US007660720B2

(12) United States Patent
Oh et al.

(10) Patent No.: US 7,660,720 B2
(45) Date of Patent: Feb. 9, 2010

(54) LOSSLESS AUDIO CODING/DECODING METHOD AND APPARATUS

(75) Inventors: Ennmi Oh, Seoul (KR); Junghoe Kim, Seoul (KR); Miao Lei, Beijing (CN); Shihwa Lee, Seoul (KR); Sangwook Kim, Seoul (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 863 days.

(21) Appl. No.: 11/076,284

(22) Filed: Mar. 10, 2005

(65) Prior Publication Data

US 2005/0203731 A1 Sep. 15, 2005

Related U.S. Application Data

(60) Provisional application No. 60/551,359, filed on Mar. 10, 2004.

(30) Foreign Application Priority Data

Jun. 30, 2004 (KR) ..... 10-2004-0050479

(51) Int. Cl.
*G10L 19/00* (2006.01)

(52) U.S. Cl. ..... 704/501; 704/230; 704/500; 704/200.1; 704/219; 704/229; 341/51; 341/107; 375/240.11; 375/240.24; 375/240

(58) Field of Classification Search ..... 704/500–504, 704/230, 219, 200.1, 240, 243, 229; 341/51, 341/107; 375/240, 240.24, 240.11
See application file for complete search history.

(56) References Cited

U.S. PATENT DOCUMENTS 6,108,625 A * 8/2000 Kim ..... 704/229
6,223,162 B1 * 4/2001 Chen et al. ..... 704/503
6,289,306 B1 * 9/2001 Van Der Vleuten et al. . 704/219
6,314,136 B1 * 11/2001 Kilgariff ..... 375/240
6,349,284 B1 * 2/2002 Park et al. ..... 704/500

(Continued)

FOREIGN PATENT DOCUMENTS

WO 03/027940 A1 4/2003
WO 03/077565 A1 9/2003

OTHER PUBLICATIONS

"Bit-plane Golomb coding for sources with Laplacian distributions" Yu, R.; Ko, C.C.; Rahardja, S.; Lin, X.; Acoustics, Speech, and Signal Processing, 2003. Proceedings. (ICASSP '03). 2003 IEEE International Conference on vol. 4, Apr. 6-10, 2003 pp. IV-277-80 vol. 4.*

(Continued)

*Primary Examiner*—Vijay B Chawan
(74) *Attorney, Agent, or Firm*—Staas & Halsey LLP

(57) ABSTRACT

A lossless audio coding and/or decoding method and apparatus are provided. The coding method includes: mapping the audio signal in the frequency domain having an integer value into a bit-plane signal with respect to the frequency; obtaining a most significant bit and a Golomb parameter for each bit-plane; selecting a binary sample on a bit-plane to be coded in the order from the most significant bit to the least significant bit and from a lower frequency component to a higher frequency component; calculating the context of the selected binary sample by using significances of already coded bit-planes for each of a plurality of frequency lines existing in the vicinity of a frequency line to which the selected binary sample belongs; selecting a probability model by using the obtained Golomb parameter and the calculated contexts; and lossless-coding the binary sample by using the selected probability model. According to the method and apparatus, a compression ratio better than that of the bit-plane Golomb code (BPGC) is provided through context-based coding method having optimal performance.

64 Claims, 14 Drawing Sheets

U.S. PATENT DOCUMENTS

| | | | | |
|---|---|---|---|---|
| 6,400,289 | B1 * | 6/2002 | Banerji | 341/60 |
| 6,535,845 | B2 * | 3/2003 | Van Der Vleuten et al. | 704/219 |
| 6,650,784 | B2 * | 11/2003 | Thyagarajan | 382/244 |
| 6,675,148 | B2 * | 1/2004 | Hardwick | 704/500 |
| 6,757,659 | B1 * | 6/2004 | Tanaka et al. | 704/501 |
| 6,778,965 | B1 * | 8/2004 | Bruekers et al. | 704/500 |
| 7,328,150 | B2 * | 2/2008 | Chen et al. | 704/219 |
| 7,424,434 | B2 * | 9/2008 | Chen et al. | 704/500 |
| 2003/0026335 | A1 * | 2/2003 | Thyagarajan | 375/240.2 |
| 2003/0026490 | A1 * | 2/2003 | Thyagarajan | 382/244 |
| 2003/0187634 | A1 | 10/2003 | Li | |
| 2004/0044520 | A1 * | 3/2004 | Chen et al. | 704/200.1 |
| 2004/0184545 | A1 * | 9/2004 | Thyagarajan | 375/240.23 |

OTHER PUBLICATIONS

"Fine grain scalable perceptual and lossless audio coding based on IntMDCT" Geiger, R.; Herre, A.; Schuller, G.; Sporer, T. Acoustics, Speech, and Signal Processing, 2003. Proceedings. (ICASSP '03). 2003 IEEE International Conference on vol. 5, Apr. 6-10, 2003 pp. V-445-8 vol. 5.*

European Search Report issued Aug. 25, 2006 in EP 05 25 1452.8, EPO, The Hague, Netherlands (in English).

Oh, Eunmi et al., "*Improvement of coding efficiency in MPEG-4 audio scalable lossless coding* (*SLS*)", ISO/IEC JTC1/SC29/WG11, MPEG2003/M10414, Dec. 2003, Hawaii, USA.

Yu, R., et al., "*A fine granular scalable perpetually lossy and lossless audio codec*", 2003 IEEE International Conference on Multimedia and Expo, Jul. 6-9, 2003, Baltimore, MD, USA, Jul. 6, 2003, pp. I-65-I-68, vol. 1, Proceedings 2003 International Conference on Multimedia and Expo (Cat. No. 03TH8698), IEEE Piscataway, NJ, USA.

* cited by examiner

FIG. 14

```
- Pseudo Code for Context Based Arithmetic Coding
/* BPGC/CBAC normal decoding */
i=0;
while ((i<LAZY_BP) && (there exists max_bp[g][sfb] - i >= 0)){
   for (g=0;g<num_windows_group;g++){
     for (sfb = 0;sfb<total_sfb;sfb++){
         cur_bp[g][sfb] = max_bp[g][sfb] - i;
         If ((cur_bp[g][sfb]>=0) && (lazy_bp[g][sfb] > 0)){
            width = swb_offset[g][sfb+1]   swb_offset[g][sfb];
            for (win=0;win<window_group_len[g];win++){
                for (bin=0;bin<width;bin++){
                  if (!is_lle_ics_eof ()){
                        freq  = CalculateFreq();
                        res[g][win][sfb][bin] += decode(freq ) << cur_bp[g][sfb];
                        /* decode bit-plane cur_bp*/
                        if ((!is_sig[g][win][sfb][bin]) && (res[g][win][sfb][bin] )) {
                        /* decode sign bit of res if necessary */
                        res[g][win][sfb][bin] *= (decode(freq_sign))? 1:-1;
                        is_sig[g][win][sfb][bin] = 1;
                        }
                  }
                }
            }
         i++;  /* progress to next bit-plane */
     }
   }
 }
```

LOSSLESS AUDIO CODING/DECODING METHOD AND APPARATUS

CROSS-REFERENCE TO RELATED PATENT APPLICATIONS

Priority is claimed to U.S. Provisional Patent Application No. 60/551,359, filed on Mar. 10, 2004, in the U.S. Patent and Trademark Office, and Korean Patent Application No. 10-2004-0050479, filed on Jun. 30, 2004, in the Korean Intellectual Property Office, the disclosures of which are incorporated herein in their entirety by reference.

BACKGROUND OF THE INVENTION

1. Field of the Invention

The present invention relates to coding and/or decoding of an audio signal, and more particularly, to a lossless audio coding/decoding method and apparatus capable of providing a greater compression ratio than in a bit-plane Golomb code (BPGC) using a text-based coding method.

2. Description of the Related Art

Lossless audio coding methods include Meridian lossless audio compression coding, Monkey's audio coding, and free lossless audio coding. Meridian lossless packing (MLP) is applied and used in a digital versatile disk-audio (DVD-A). As the bandwidth of Internet network increases, a large volume of multimedia contents can be provided. In the case of audio contents, a lossless audio method is needed. In the European Union (EU), digital audio broadcasting has already begun through digital audio broadcasting (DAB), and broadcasting stations and contents providers for this are using lossless audio coding methods. In response to this, MPEG group is also proceeding with standardization for lossless audio compression under the name of ISO/IEC 14496-3: 2001/AMD 5, Audio Scalable to Lossless Coding (SLS). This provides fine grain scalability (FGS) and enables lossless audio compression.

A compression ratio, which is the most important factor in a lossless audio compression technology, can be improved by removing redundant information between data items. The redundant information can be removed by prediction between neighboring data items and can also be removed by a context between neighboring data items.

Integer modified discrete cosine transform (MDCT) coefficients show a Laplacian distribution, and in this distribution, a compression method named Golomb code shows an optimal result. In order to provide the FGS, bit-plane coding is needed and a combination of the Golomb code and bit-plane coding is referred to as bit plane Golomb coding (BPGC), which provides an optimal compression ratio and FGS. However, in some cases the assumption that the integer MDCT coefficients show a Laplacian distribution is not correct in an actual data distribution. Since the BPGC is an algorithm devised assuming that integer MDCT coefficients show a Laplacian distribution, if the integer MDCT coefficients do not show a Laplacian distribution, the BPGC cannot provide an optimal compression ratio. Accordingly, a lossless audio coding and decoding method capable of providing an optimal compression ratio regardless of the assumption that the integer MDCT coefficients show a Laplacian distribution is needed.

SUMMARY OF THE INVENTION

The present invention provides a lossless audio coding/decoding method and apparatus capable of providing an optimal compression ratio regardless of the assumption that integer MDCT coefficients show a Laplacian distribution.

According to an aspect of the present invention, there is provided a lossless audio coding method including: mapping the audio spectral signal in the frequency domain having an integer value into a bit-plane signal with respect to the frequency; obtaining a most significant bit and a Golomb parameter for each bit-plane; selecting a binary sample on a bit-plane to be coded in the order from the most significant bit to the least significant bit and from a lower frequency component to a higher frequency component; calculating the context of the selected binary sample by using significances of already coded bit-planes for each of a plurality of frequency lines existing in the vicinity of a frequency line to which the selected binary sample belongs; selecting a probability model of the binary sample by using the obtained Golomb parameter and the calculated contexts; and lossless-coding the binary sample by using the selected probability model.

In the calculating of the context of the selected binary sample, the significances of already coded samples of bit-planes on each identical frequency line in a plurality of frequency lines existing in the vicinity of a frequency line to which the selected binary sample belongs are obtained, and by binarizing the significances, the context value of the binary sample is calculated.

In the calculating of the context of the selected binary sample, the significances of already coded samples of bit-planes on each identical frequency line in a plurality of frequency lines existing before a frequency line to which the selected binary sample belongs are obtained; a ratio on how many lines among the plurality of frequency lines have significance is expressed in an integer, by multiplying the ratio by a predetermined integer value; and then, the context value is calculated by using the integer.

According to another aspect of the present invention, there is provided a lossless audio coding method including: scaling the audio spectral signal in the frequency having an integer value domain to be used as an input signal of a lossy coder; lossy compression coding the scaled frequency signal; obtaining an error mapped signal corresponding to the difference of the lossy coded data and the audio spectral signal in the frequency domain having an integer value; lossless-coding the error mapped signal by using a context obtained based on the significances of already coded bit-planes for each of a plurality of frequency lines existing in the vicinity of a frequency line to which the error mapped signal belongs; and generating a bitstream by multiplexing the lossless coded signal and the lossy coded signal.

The lossless-coding of the error mapped signal may include: mapping the error mapped signal into bit-plane data with respect to the frequency; obtaining the most significant bit and Golomb parameter of the bit-plane; selecting a binary sample on a bit-plane to be coded in the order from a most significant bit to a least significant bit and a lower frequency component to a higher frequency component; calculating the context of the selected binary sample by using significances of already coded bit-planes for each of a plurality of frequency lines existing in the vicinity of a frequency line to which the selected binary sample belongs; selecting a probability model by using the obtained Golomb parameter and the calculated contexts; and lossless-coding the binary sample of the binary sample by using the selected probability model.

In the calculating of the context of the selected binary sample, the significances of already coded samples of bit-planes on each identical frequency line in a plurality of frequency lines existing in the vicinity of a frequency line to which the selected binary sample belongs are obtained, and by binarizing the significances, the context value of the binary sample is calculated.

In the calculating of the context of the selected binary sample, the significances of already coded samples of bit-planes on each identical frequency line in a plurality of frequency lines existing before a frequency line to which the selected binary sample belongs are obtained; a ratio on how many lines among the plurality of frequency lines have significance is expressed in an integer, by multiplying the ratio by a predetermined integer value; and then, the context value is calculated by using the integer.

According to still another aspect of the present invention, there is provided a lossless audio coding apparatus including: a bit-plane mapping unit mapping the audio signal in the frequency domain having an integer value into bit-plane data with respect to the frequency; a parameter obtaining unit obtaining a most significant bit and a Golomb parameter for the bit-plane; a binary sample selection unit selecting a binary sample on a bit-plane to be coded in the order from the most significant bit to the least significant bit and from a lower frequency component to a higher frequency component; a context calculation unit calculating the context of the selected binary sample by using significances of already coded bit-planes for each of a plurality of frequency lines existing in the vicinity of a frequency line to which the selected binary sample belongs; a probability model selection unit selecting a probability model by using the obtained Golomb parameter and the calculated contexts; and a binary sample coding unit lossless-coding the binary sample by using the selected probability model. The integer time/frequency transform unit may be an integer modified discrete cosine transform (MDCT) unit.

According to yet still another aspect of the present invention, there is provided a lossless audio coding apparatus including: a scaling unit scaling the audio spectral signal in the frequency domain having an integer value to be used as an input signal of a lossy coder; a lossy coding unit lossy compression coding the scaled frequency signal; an error mapping unit obtaining the difference of the lossy coded signal and the signal of the integer time/frequency transform unit; a lossless coding unit losslessly-coding the error mapped signal by using a context obtained based on the significances of already coded bit-planes for each of a plurality of frequency lines existing in the vicinity of a frequency line to which the error mapped signal belongs; and a multiplexer generating a bitstream by multiplexing the lossless coded signal and the lossy coded signal.

The lossless-coding unit may include: a bit-plane mapping unit mapping the error mapped signal of the error mapping unit into bit-plane data with respect to the frequency; a parameter obtaining unit obtaining the most significant bit and Golomb parameter of the bit-plane; a binary sample selection unit selecting a binary sample on a bit-plane to be coded in the order from a most significant bit to a least significant bit and a lower frequency component to a higher frequency component; a context calculation unit calculating the context of the selected binary sample by using the significances of already coded bit-planes for each of a plurality of frequency lines existing in the vicinity of a frequency line to which the selected binary sample belongs; a probability model selection unit selecting a probability model by using the obtained Golomb parameter and the calculated contexts; and a binary sample coding unit lossless-coding the binary sample by using the selected probability model.

According to a further aspect of the present invention, there is provided a lossless audio decoding method including: obtaining a Golomb parameter from a bitstream of audio data; selecting a binary sample to be decoded in the order from a most significant bit to a least significant bit and from a lower frequency to a higher frequency; calculating the context of a binary sample to be decoded by using the significances of already decoded bit-planes for each of a plurality of frequency lines existing in the vicinity of a frequency line to which the binary sample to be decoded belongs; selecting a probability model by using the Golomb parameter and the context; performing arithmetic-decoding by using the selected probability model; and repeatedly performing the operations from the selecting of a binary sample to be decoded to the arithmetic decoding until all samples are decoded.

The calculating of the context may include: calculating a first context by using the significances of already decoded samples of bit-plane on each identical frequency line in a plurality of frequency lines existing in the vicinity of a frequency line to which a sample to be decoded belongs; and calculating a second context by using the significances of already decoded samples of bit-planes on each identical frequency line in a plurality of frequency lines before a frequency line to which a sample to be decoded belongs.

According to an additional aspect of the present invention, there is provided a lossless audio decoding method wherein the difference of lossy coded audio data and an audio spectral signal in the frequency domain having an integer value is referred to as error data, the method including: extracting a lossy bitstream lossy-coded in a predetermined method and an error bitstream of the error data, by demultiplexing an audio bitstream; lossy-decoding the extracted lossy bitstream in a predetermined method; lossless-decoding the extracted error bitstream, by using a context based on the significances of already decoded samples of bit-planes on each identical line of a plurality of frequency lines existing in the vicinity of a frequency line to which a sample to be decoded belongs; restoring a frequency spectral signal by using the decoded lossy bitstream and error bitstream; and restoring an audio signal in the time domain by inverse integer time/frequency transforming the frequency spectral signal.

The lossless-decoding of the extracted error bitstream may include: obtaining a Golomb parameter from a bitstream of audio data; selecting a binary sample to be decoded in the order from a most significant bit to a least significant bit and from a lower frequency to a higher frequency; calculating the context of the selected binary sample by using the significances of already coded bit-planes for each of a plurality of frequency lines existing in the vicinity of a frequency line to which the selected binary sample belongs; selecting a probability model by using the Golomb parameter and context; performing arithmetic-decoding by using the selected probability model; and repeatedly performing the operations from selecting the binary sample to performing arithmetic-decoding, until all samples are decoded.

The calculating of the context may include: calculating a first context by using the significances of already decoded samples of bit-plane on each identical frequency line in a plurality of frequency lines existing in the vicinity of a frequency line to which a sample to be decoded belongs; and calculating a second context by using the significances of already decoded samples of bit-planes on each identical frequency line in a plurality of frequency lines before a frequency line to which a sample to be decoded belongs.

According to an additional aspect of the present invention, there is provided a lossless audio decoding apparatus including: a parameter obtaining unit obtaining a Golomb parameter from a bitstream of audio data; a sample selection unit selecting a binary sample to be decoded in the order from a most significant bit to a least significant bit and from a lower frequency to a higher frequency; a context calculation unit calculating the context of a binary sample to be decoded by using the significances of already decoded bit-planes for each of a plurality of frequency lines existing in the vicinity of a frequency line to which the binary sample to be decoded belongs; a probability model selection unit selecting a probability model by using the Golomb parameter and the context; and an arithmetic decoding unit performing arithmetic-decoding by using the selected probability model.

The context calculation unit may include: a first context calculation unit calculating a first context by obtaining the significances of already decoded samples of bit-planes on each identical frequency line in a plurality of frequency lines existing in the vicinity of a frequency line to which a sample to be decoded belongs and binarizing the significances; and a second context calculation unit calculating a second context by obtaining the significances of already decoded samples of bit-planes on each identical frequency line in a plurality of frequency lines existing before a frequency line to which a sample to be decoded belongs, expressing a ratio on how many lines among the plurality of frequency lines have significance, in an integer by multiplying the ratio by a predetermined integer value, and then, by using the integer.

According to an additional aspect of the present invention, there is provided a lossless audio decoding apparatus wherein the difference of lossy coded audio data and an audio spectral signal in the frequency domain having an integer value is referred to as error data, the apparatus including: a demultiplexing unit extracting a lossy bitstream lossy-coded in a predetermined method and an error bitstream of the error data, by demultiplexing an audio bitstream; a lossy decoding unit lossy-decoding the extracted lossy bitstream in a predetermined method; a lossless decoding unit lossless-decoding the extracted error bitstream, by using a context based on the significances of already decoded samples of bit-planes on each identical line of a plurality of frequency lines existing in the vicinity of a frequency line to which a sample to be decoded belongs; an audio signal synthesis unit restoring a frequency spectral signal by synthesizing the decoded lossy bitstream and error bitstream; and an inverse integer time/frequency transform unit restoring an audio signal in the time domain by inverse integer time/frequency transforming the frequency spectral signal. The lossy decoding unit may be an AAC decoding unit. The apparatus may further include: an inverse time/frequency transform unit restoring an audio signal in the time domain from the audio signal in the frequency domain decoded by the lossy decoding unit.

The lossless decoding unit may include: a parameter obtaining unit obtaining a Golomb parameter from a bitstream of audio data; a parameter obtaining unit obtaining a Golomb parameter from a bitstream of audio data; a sample selection unit selecting a binary sample to be decoded in the order from a most significant bit to a least significant bit and from a lower frequency to a higher frequency; a context calculation unit calculating the context of the selected binary sample by using the significances of already coded bit-planes for each of a plurality of frequency lines existing in the vicinity of a frequency line to which the selected binary sample belongs; a probability model selection unit selecting a probability model by using the Golomb parameter and context; and an arithmetic decoding unit performing arithmetic-decoding by using the selected probability model.

The context calculation unit may include: a first context calculation unit obtaining the significances of already coded samples of bit-planes on each identical frequency line in a plurality of frequency lines existing in the vicinity of a frequency line to which the selected binary sample belongs, and by binarizing the significances, calculating a first context; and a second context calculation unit obtaining the significances of already coded samples of bit-planes on each identical frequency line in a plurality of frequency lines existing before a frequency line to which the selected binary sample belongs, expressing a ratio on how many lines among the plurality of frequency lines have significance, in an integer, by multiplying the ratio by a predetermined integer value, and then, calculating a second context by using the integer.

According to an additional aspect of the present invention, there is provided a computer readable recording medium having embodied thereon a computer program for the methods.

BRIEF DESCRIPTION OF THE DRAWINGS

The above and other features and advantages of the present invention will become more apparent by describing in detail exemplary embodiments thereof with reference to the attached drawings in which:

FIG. 14 is an example type of a pseudo code for context-based coding according to the present invention;

DETAILED DESCRIPTION OF THE INVENTION

A lossless audio coding/decoding method and apparatus according to the present invention will now be described more fully with reference to the accompanying drawings, in which exemplary embodiments of the invention are shown.

In audio coding, in order to provide fine grain scalability (FGS) and lossless coding, integer modified discrete cosine transform (MDCT) is used. In particular, it is known that if the input sample distribution of the audio signal follows Laplacian distribution, a bit plane Golomb coding (BPGC) method shows an optimal compression result, and this provides a result equivalent to a Golomb code. A Golomb parameter can be obtained by the following procedure:

$$\text{For}(L=0;(N<<L+1))<=A;L++);$$

According to the procedure, Golomb parameter L can be obtained and due to the characteristic of the Golomb code, a probability that 0 or 1 appears in a bit-plane less than L is equal to 1/2. In the case of Laplacian distribution this result is optimal but if the distribution is not a Laplacian distribution, an optimal compression ratio cannot be provided. Accordingly, a basic idea of the present invention is to provide an optimal compression ratio (by using a context through a statistical analysis via a data distribution) that does not follow the Laplacian distribution.

Figure 1:
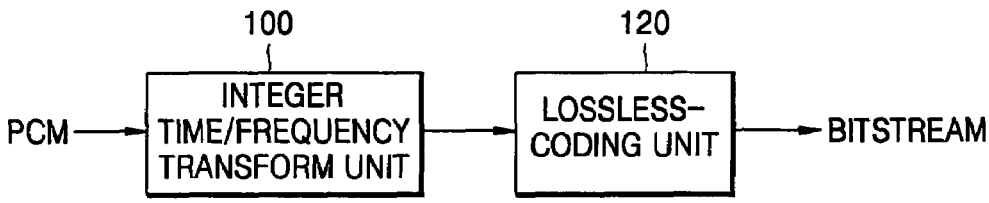
FIG. 1 is a block diagram of the structure of an exemplary embodiment of a lossless audio coding apparatus according to the present invention.

FIG. 1 is a block diagram of the structure of an exemplary embodiment of a lossless audio coding apparatus according to the present invention. The lossless audio coding apparatus includes an integer time/frequency transform unit 100 and a lossless coding unit 120. The integer time/frequency transform unit 100 transforms an audio signal in the time domain into an audio spectral signal in the frequency domain having an integer value, and preferably, uses integer MDCT. The lossless coding unit 120 maps the audio signal in the frequency domain into bit-plane data with respect to the frequency, and lossless-codes binary samples forming the bit-plane using a predetermined context. The lossless coding unit 120 is formed with a bit-plane mapping unit 200, a parameter obtaining unit 210, a binary sample selection unit 220, a context calculation unit 230, a probability model selection unit 240, and a binary sample coding unit 250.

Figure 8:
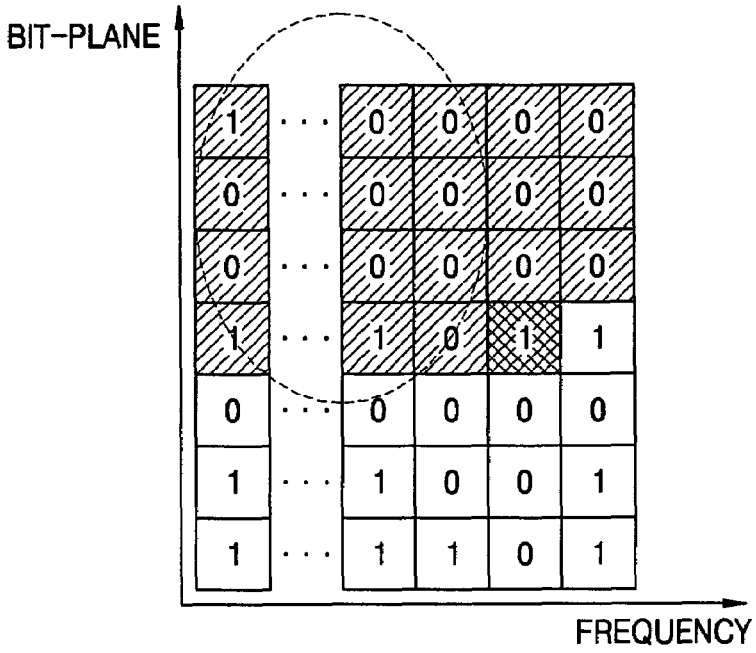
FIG. 8 is a diagram showing a global context in a context calculation unit.
Figure 10:
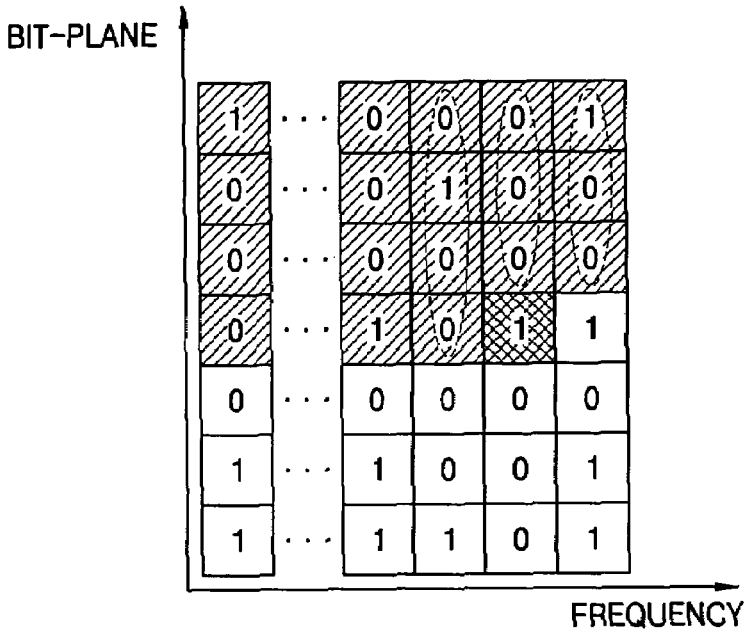
FIG. 10 is a diagram showing a local context in a context calculation unit.

The bit-plane mapping unit 200 maps the audio signal in the frequency domain into bit-plane data with respect to the frequency. FIGS. 8 and 10 illustrate examples of audio signals mapped into bit-plane data with respect to the frequency.

The parameter obtaining unit 210 obtains the most significant bit (MSB) of the bit-plane and a Golomb parameter. The binary sample selection unit 220 selects a binary sample on a bit-plane to be coded in the order from a MSB to a least significant bit (LSB) and from a lower frequency component to a higher frequency component.

The context calculation unit 230 calculates the context of the selected binary sample by using the significances of already coded bit-planes for each of a plurality of frequency lines existing in the vicinity of a frequency line to which the selected binary sample belongs. The probability model selection unit 240 selects a probability model by using the obtained Golomb parameter and the calculated contexts. The binary sample coding unit 250 lossless-codes the binary sample by using the selected probability model.

Figure 2:
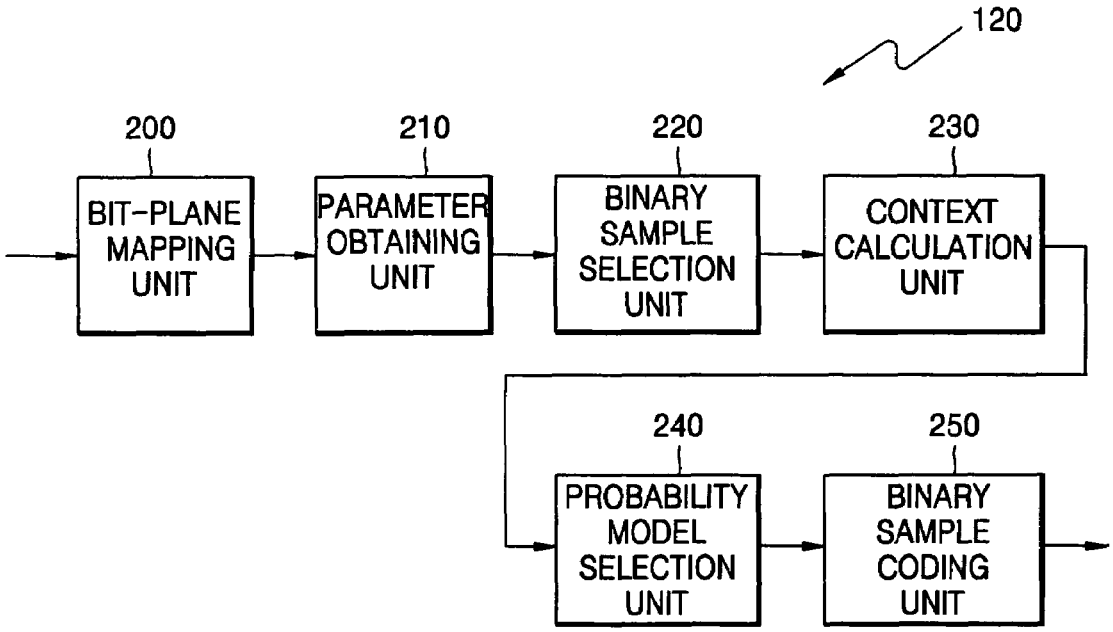
FIG. 2 is a block diagram of the structure of a lossless coding unit of FIG. 1.

In FIG. 2 all binary samples are coded using context-based lossless coding. However, in another embodiment, for complexity some binary samples on the bit-plane are coded using context-based lossless coding and other binary samples on the bit-plane are coded using bit-packing. Golomb parameter is used for determining binary samples on bit-plane to be coded using bit-packing since a probability of being '1' of the binary sample under the Golomb parameter is 1/2.

Figure 3:
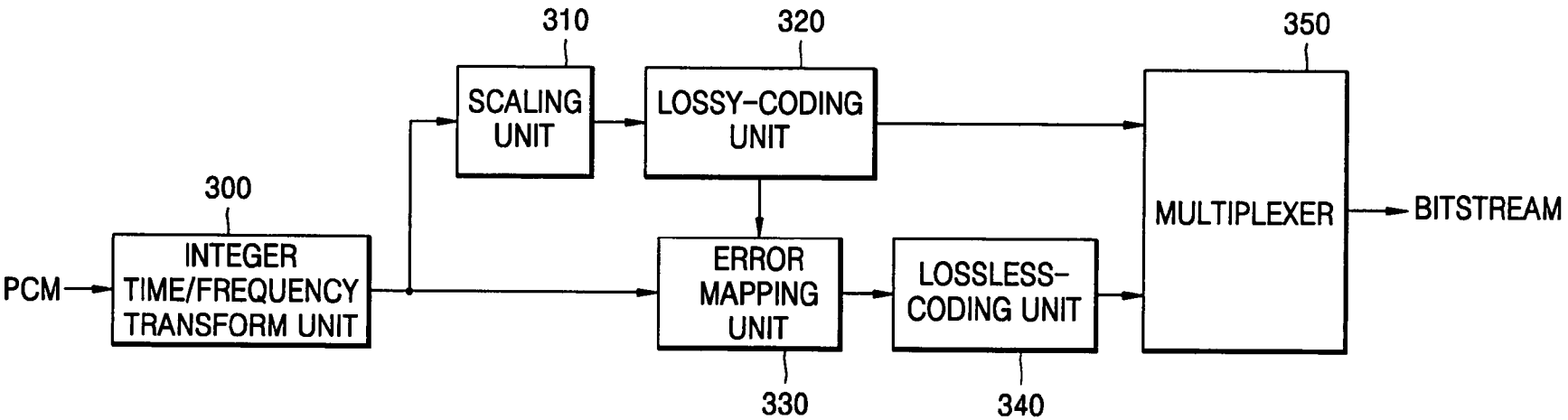
FIG. 3 is a block diagram of the structure of another exemplary embodiment of the lossless audio coding apparatus according to the present invention.

FIG. 3 is a block diagram of the structure of another exemplary embodiment of the lossless audio coding apparatus according to the present invention. The apparatus is formed with an integer time/frequency transform unit 300, a scaling unit 310, a lossy coding unit 320, an error mapping unit 330, a lossless coding unit 340, and a multiplexer 350.

The integer time/frequency transform unit 300 an audio signal in the time domain into an audio spectral signal in the frequency domain having an integer value, and preferably uses integer MDCT. The scaling unit 310 scales the audio frequency signal of the integer time/frequency transform unit 300 to be used as an input signal of the lossy coding unit 320. Since the output signal of the integer time/frequency transform unit 300 is represented as an integer, it cannot be directly used as an input of the lossy coding unit 320. Accordingly, the audio frequency signal of the integer time/frequency transform unit 300 is scaled in the scaling unit so that it can be used as an input signal of the lossy coding unit 320.

The lossy coding unit 320 lossy-codes the scaled frequency signal and preferably, uses an AAC core coder. The error mapping unit 330 obtains an error mapped signal corresponding to the difference of the lossy-coded signal and the signal of the integer time/frequency transform unit 300. The lossless coding unit 340 lossless-codes the error mapped signal by using a context. The multiplexer 350 multiplexes the lossless-coded signal of the lossless coding unit 340 and the lossy-coded signal of the lossy coding unit 320, and generates a bitstream.

Figure 4:
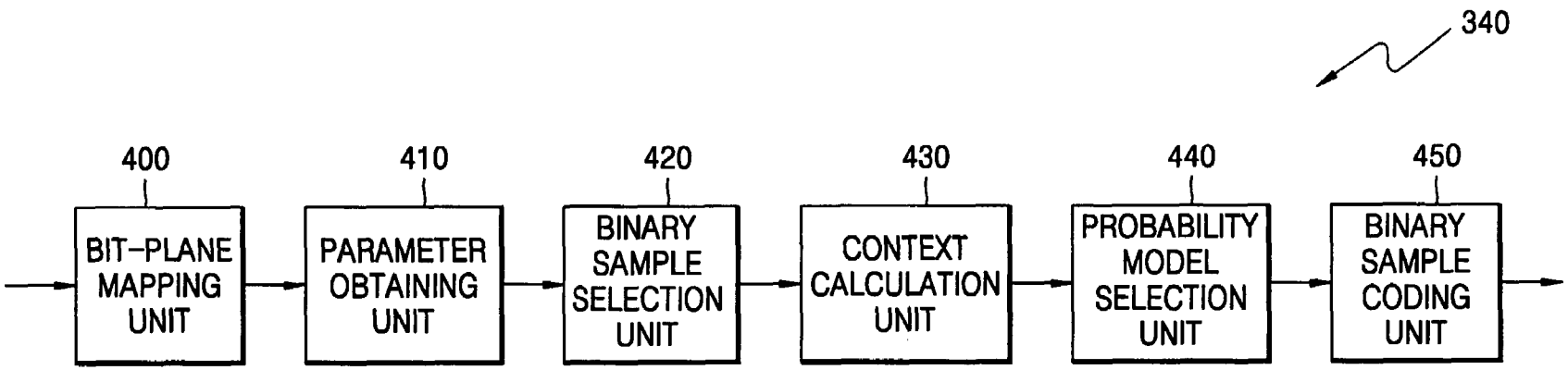
FIG. 4 is a block diagram of the structure of a lossless coding unit of FIG. 3.

FIG. 4 is a block diagram of the structure of the lossless coding unit 340, which is formed with a bit-plane mapping unit 400, a parameter obtaining unit 410, a binary sample selection unit 420, a context calculation unit 430, a probability model selection unit 440, and a binary sample coding unit 450.

The bit-plane mapping unit 400 maps the error mapped signal of the error mapping unit 330 into bit-plane data with respect to the frequency. The parameter obtaining unit 410 obtains the MSB of the bit-plane and a Golomb parameter. The binary sample selection unit 420 selects a binary sample on a bit-plane to be coded in the order from a MSB to a LSB, and from a lower frequency component to a higher frequency component. The context calculation unit 430 calculates the context of the selected binary sample, by using the significances of already coded bit-planes for each of a plurality of frequency lines existing in the vicinity of a frequency line to which the selected binary sample belongs. The probability model selection unit 440 selects a probability model by using the obtained Golomb parameter and the calculated contexts. The binary sample coding unit 450 lossless-codes the binary sample by using the selected probability model.

In FIG. 4 all binary samples are coded using context-based lossless coding. However, in another embodiment, for complexity reduction some binary samples on the bit-plane are coded using context-based lossless coding and other binary samples on the bit-plane are coded using bit-packing. Golomb parameter is used for determining binary samples on bit-plane to be coded using bit-packing since a probability of being '1' of the binary sample under the Golomb parameter is 1/2.

Calculation of a context value of the binary sample in the context calculation units 230 and 430 shown in FIGS. 2 and 4 will now be explained. The significance that is used in relateion to the exemplary embodiment of the present invention is defined as 1 if one spectral component is coded as 1 at least once among previous samples coded on bit-planes on an identical frequency line to a current time, and defined as 0 if no spectral component is coded as 1.

Also, the context calculation units 230 and 430 can calculate the context of the binary sample using, for example, global context calculation. The global context calculation considers the distribution of the entire spectrum, and uses the fact that the shape of the envelope of the spectrum does not change rapidly on the frequency axis, and comes to have a look similar to the shape of the previous envelope. In the global context calculation, taking the frequency line of the selected binary sample as a basis, the context calculation units 230 and 430 obtain a probability value that the significance is '1' by using already coded predetermined samples among bit-planes on each frequency line existing before the frequency line of the selected binary sample. Then, the context calculation units 230 and 420 multiply the probability value by a predetermined integer value to express it in an integer, and by using the integer, calculate the context value of the binary sample.

Also, the context calculation units 230 and 430 can calculate the context of the binary sample using local context calculation. The local context calculation uses correlation of adjacent binary samples, and the significance as the global context calculation. The significance of a sample on each of predetermined N bitstreams on an identical frequency of a binary sample to be currently coded is binarized and then, converted again into a decimal number, and then, the context is calculated. In the local context calculation, taking the frequency line of the selected binary sample as the basis, the context calculation unit 230 and 430 obtain respective significances by using predetermined samples among bit-planes on each of frequency lines existing in a predetermined range before and after the frequency line of the selected binary sample, and by converting the significances into scalar values, calculate the context value of the binary sample. Value N used in this calculation is less than value M used in the global context calculation.

Figure 5:
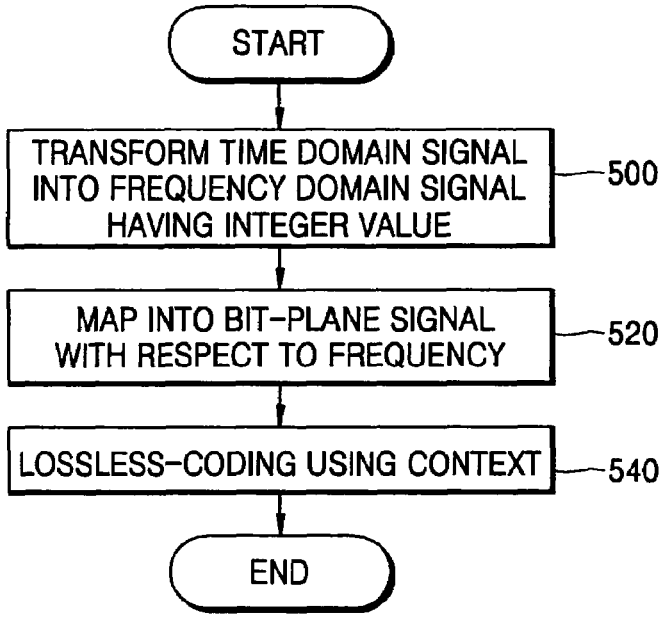
FIG. 5 is a flowchart of the operations performed by the lossless audio coding apparatus shown in FIG. 1.

FIG. 5 is a flowchart of the operations performed by the lossless audio coding apparatus shown in FIG. 1. First, a PCM signal corresponding to an audio signal in the time domain is input to the integer time/frequency transform unit 100, this is transformed to an audio spectral signal in the frequency domain having an integer value in operation 500. Here, preferably, int MDCT is used. Then, as in FIGS. 8 and 10, the audio signal in the frequency domain is mapped into a bit-plane signal with respect to the frequency in operation 520. Then, a binary sample forming the bit-plane is lossless-coded using a probability model determined by using a predetermined context in operation 540.

Figure 6:
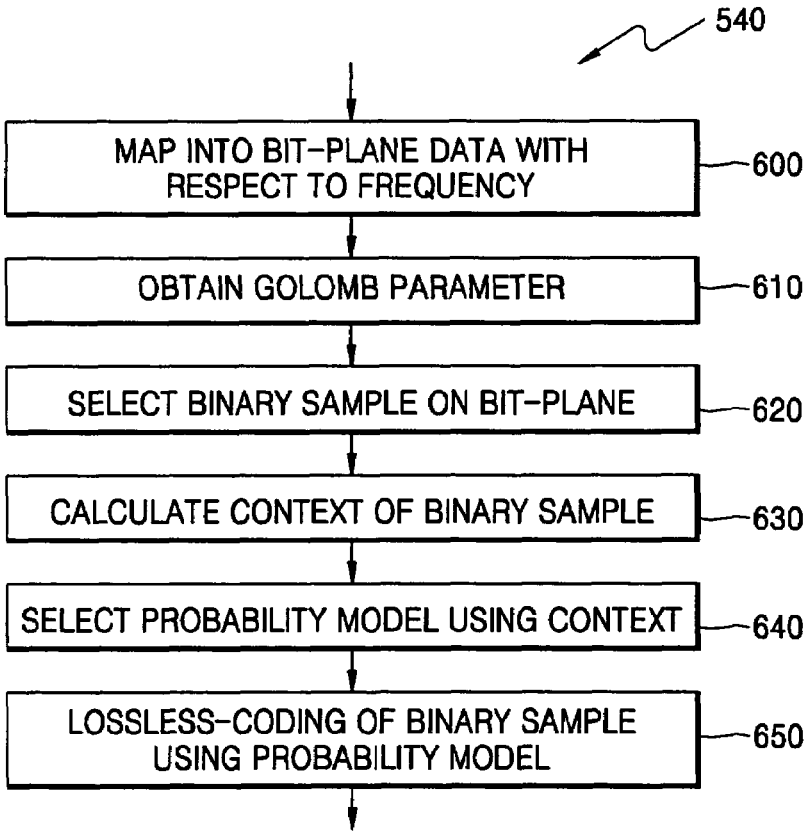
FIG. 6 is a flowchart of the operations performed by the lossless coding unit shown in FIG. 1.

FIG. 6 is a flowchart of the operations performed by the lossless coding unit 120 shown in FIG. 1.

First, if the audio signal in the frequency domain is input to the bit-plane mapping unit 200, the audio signal in the frequency domain is mapped into bit-plane data with respect to the frequency in operation 600. Also, through the Golomb parameter obtaining unit 210, the MSB and a Golomb parameter are obtained in each bit-plane in operation 610. Then, through the binary sample selection unit 220, a binary sample on a bit-plane to be coded in the order from a MSB to a LSB and from a lower frequency component to a higher frequency component is selected in operation 620. With regard to the selected binary sample, the context of the binary sample selected in the binary sample selection unit 220 is calculated by using the significances of already coded bit-planes for each of a plurality of frequency lines existing in the vicinity of a frequency line to which the selected binary sample belongs, in operation 630. A probability model is selected by using the Golomb parameter obtained in the Golomb parameter obtaining unit 210 and the contexts calculated in the context calculation unit 230 in operation 640. By using the probability model selected in the probability model selection unit 240, the binary sample is lossless-coded in operation 650.

In FIG. 6 all binary samples are coded using context-based lossless coding. However, in another exemplary embodiment, for complexity reduction some binary samples on the bit-plane are coded using context-based lossless coding and other binary samples on the bit-plane are coded using bit-packing. Golomb parameter is used for determining binary samples on bit-plane to be coded using bit-packing since a probability of being '1' of the binary sample under the Golomb parameter is 1/2.

Figure 7:
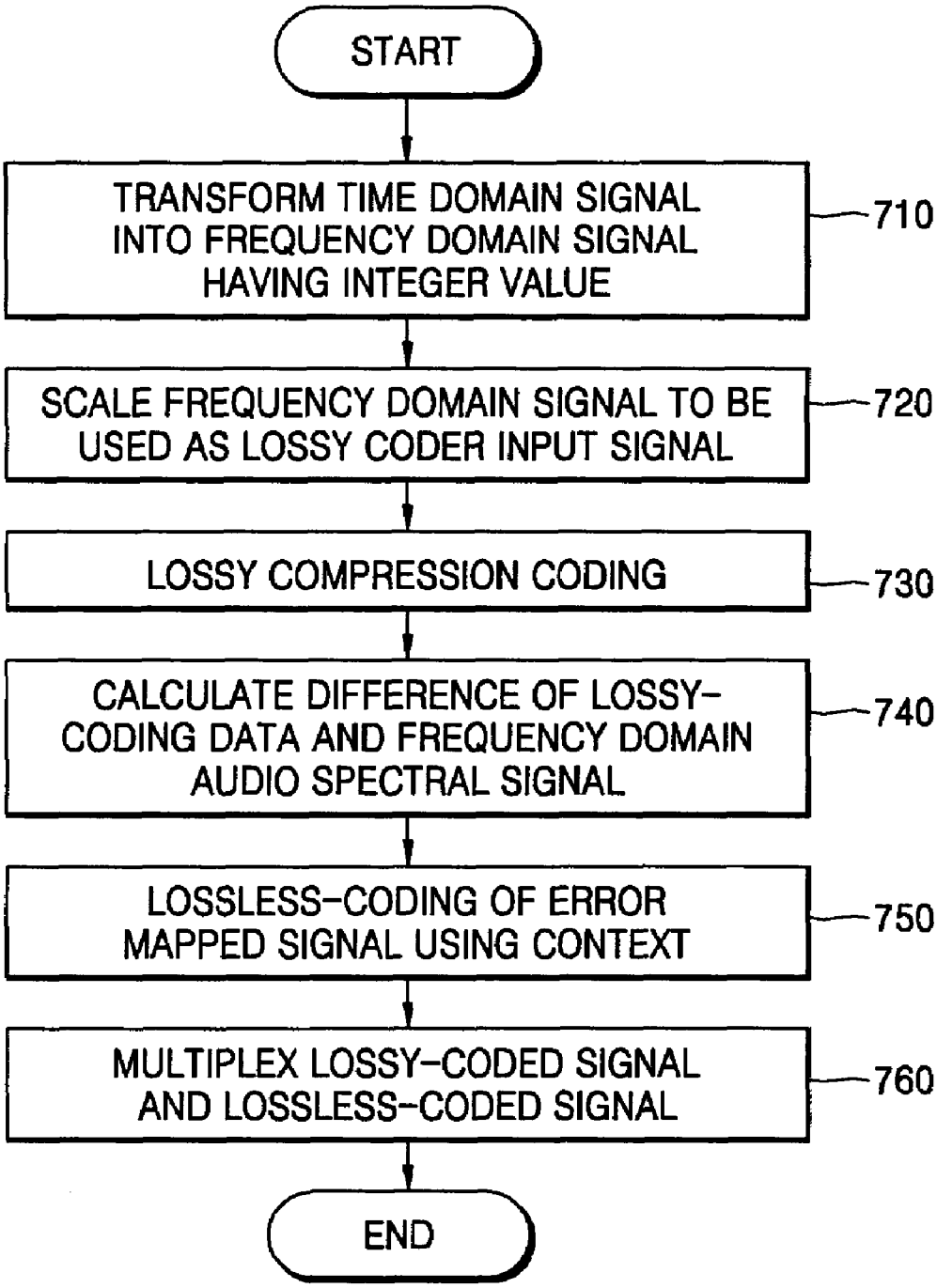
FIG. 7 is a flowchart of the operations performed by the lossless audio coding apparatus shown in FIG. 3.

FIG. 7 is a flowchart of the operations performed by the lossless audio coding apparatus shown in FIG. 3, and referring to FIG. 7, the operation of another exemplary embodiment of the lossless audio coding apparatus will now be explained. First, through the integer time/frequency transform unit 300, an audio signal in the time domain is transformed into an audio spectral signal in the frequency domain having an integer value in operation 710.

Then, the audio spectral signal in the frequency domain is scaled in the scaling unit 310 to be used as an input signal of the lossy coding unit 320 in operation 720. The frequency signal scaled in the scaling unit 310 is lossy compression coded in the lossy compression coding unit 320 in operation 730. Preferably, the lossy compression coding is performed by an AAC Core coder.

An error mapped signal corresponding to the difference of the data lossy-coded in the lossy coding unit 320 and the audio spectral signal in the frequency domain having an integer value is obtained in the error mapping unit 330 in operation 740. The error mapped signal is lossless-coded by using a context in the lossless coding unit 340 in operation 750.

The signal lossless-coded in the lossless coding unit 340 and the signal lossy-coded in the lossy coding unit 320 are multiplexed in the multiplexer 350 and are generated as a bitstream in operation 760. In the lossless coding in operation 750, the error mapped signal is mapped into bit-plane data with respect to the frequency. Then, the process of obtaining the MSB and Golomb parameter is the same as described with reference to FIG. 6 and will be omitted here.

Generally, due to spectral leakage by MDCT, there is correlation of neighboring samples on the frequency axis. That is, if the value of an adjacent sample is X, it is highly probable that the value of a current sample is a value in the vicinity of X. Accordingly, if an adjacent sample in the vicinity of X is selected as a context, the compression ratio can be improved by using the correlation.

Also, it can be known through statistical analyses that the value of a bit-plane has a higher correlation with the probability distribution of a lower order sample. Accordingly, if an adjacent sample in the vicinity of X is selected as a context, the compression ratio can be improved by using the correlation.

A method of calculating a context will now be explained.

Figure 9:
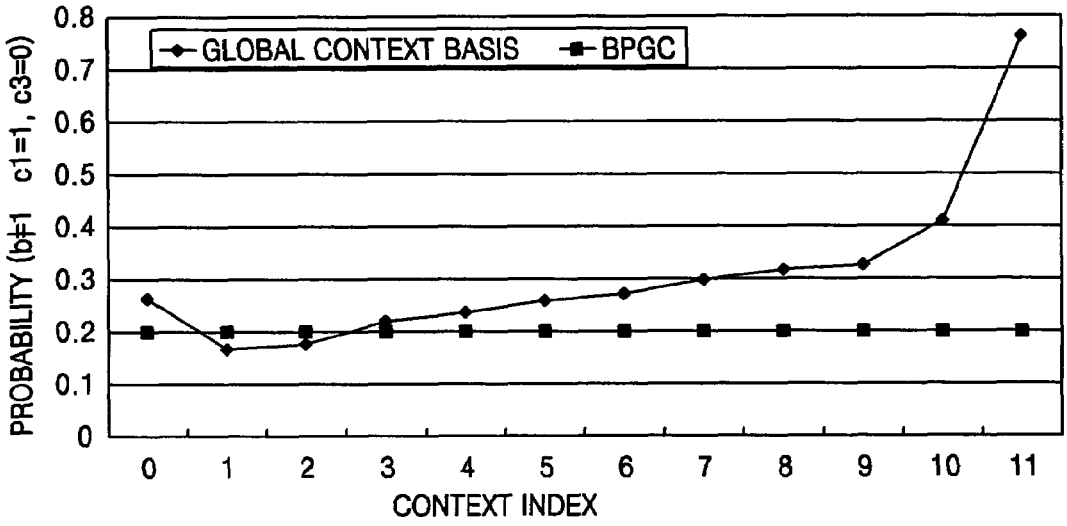
FIG. 9 is a graph showing a probability that 1 appears when a global context is calculated in a context calculation unit.

FIG. 8 is a diagram to obtain a context by using a global context in a context calculation unit. By using the part indicated by dotted lines, the probability distribution of a current sample is obtained from already coded samples. FIG. 9 is a graph showing a probability that 1 appears when a context is calculated in a context calculation unit using a global context.

Referring to FIG. 8, it is assumed that a symbol in the box indicated by grid lines is going to be coded. In FIG. 8, the global context is expressed as the part in the dotted oval. Referring to FIG. 9, the other two types of contexts are fixed as Golomb context (Context 1)=1, and local context (Context 2)=0. The graph shows that in the context calculation using the BPGC, the probability that 1 appears is maintained at a constant level, while the context calculation using the global context, the probability that 1 appears increases gradually as the context index becomes higher.

Figure 11:
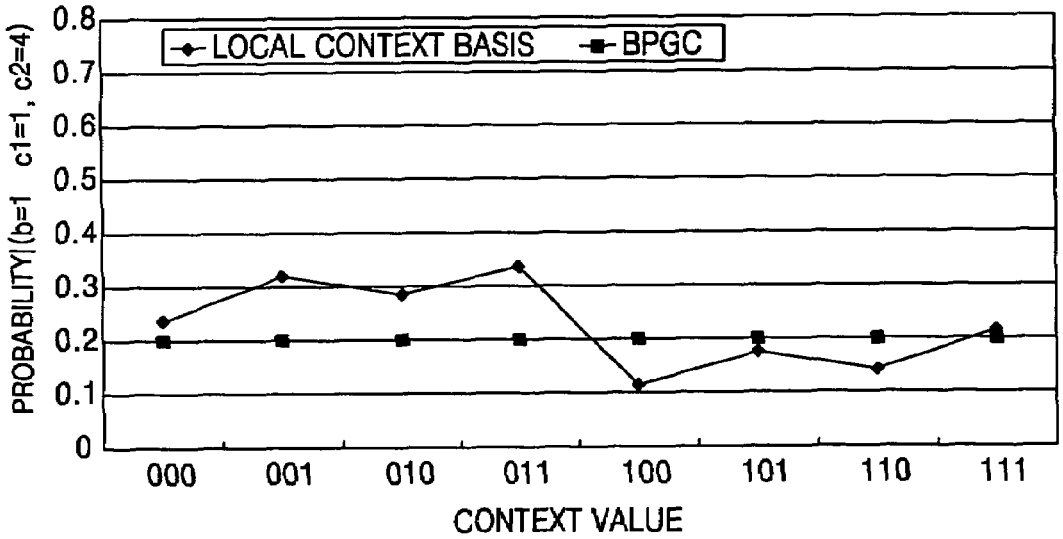
FIG. 11 is a graph showing a probability that 1 appears when a local context is calculated in a context calculation unit.

FIG. 10 is a diagram to obtain a context by using a local context in a context calculation unit. FIG. 11 is a graph showing a probability that 1 appears when a context is calculated in a context calculation unit using a local context.

Referring to FIG. 10, in the local context calculation, significances are obtained on three neighboring frequency lines. Bit pattern is mapped to a value in a range from 0 to 7 (that is, 000, 001, 010, 011, 100, 110, 111 in binary numbers) to compute symbol probability. In the local context calculation, by using the three parts indicated by dotted lines, as shown in FIG. 10, the probability distribution of a current sample is calculated from already coded samples. Here, the probability that 1 appears in the current coding is in the range from 0 to 7 as shown above, and is determined by the three values such as bit pattern [0,1,1]. FIG. 11 shows the probability that 1 appear when a context is calculated using a local context when the other two contexts are fixed as Golomb context (Context 1)=1 and global context (Context 2)=4. Here, the graph shows that when the BPGC is used, the probability that 1 appears is fixed at a constant level. Meanwhile, when the context is calculated by a global context, the probability that 1 appears is higher in the first half than that of the BPGC, but is lower in the second half than that of the BPGC.

In an actual example of coding, if among 10 neighboring samples to be coded in order to calculate a global context, five samples have significance 1, the probability is 0.5 and if this is scaled with a value of 8, it becomes a value of 4. Accordingly, the global context is 4. Meanwhile, when significances of 2 samples before and after are checked in order to calculate a local context, if (i−2)-th sample is 1, (i−1)-th sample is 0, (i+1)-th sample is 0, and (i+2)-th sample is 1, the result of binarization is 1001, and equal to 9 in the decimal expression. If the Golomb parameter of data to be currently coded is 4, Golomb parameter (Context 1)=4, global context (Context 2)=4, and local context (Context 3)=9. By using the Golomb parameter, global context, and local context, a probability model is selected. The probability models varies with respect to the implementation, and among them, using a three-dimensional array, one implementation method can be expressed as:

Prob[Golomb][Context1][Context2]

Using thus obtained probability model, lossless-coding is performed. As a representative lossless coding method, an arithmetic coding method can be used.

By the present invention, overall compression is improved by 0.8% when it's compared with prior method not using the context.

Figure 12:
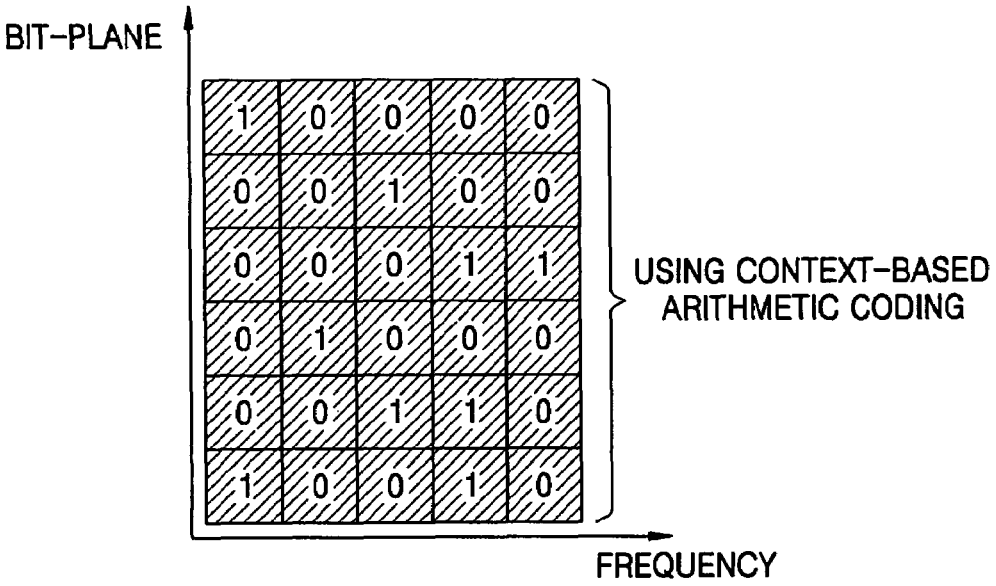
FIG. 12 is a diagram showing a full context mode of an exemplary embodiment according to the present invention.
Figure 13:
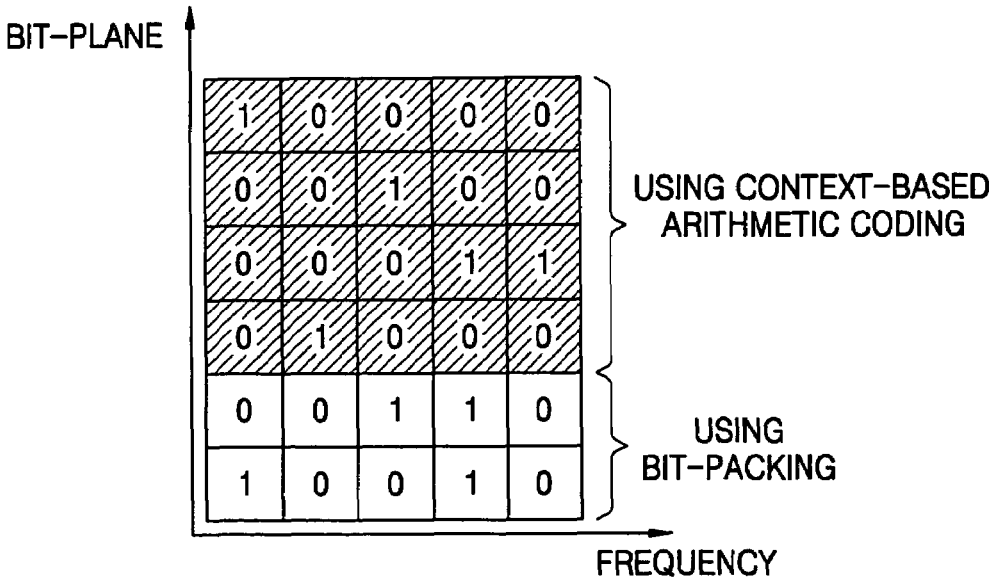
FIG. 13 is a diagram showing a partial context mode of an exemplary embodiment according to the present invention.

FIG. 12 is a diagram showing a full context mode of an exemplary embodiment according to the present invention. FIG. 13 is a diagram showing a partial context mode of an exemplary embodiment according to the present invention.

Referring to FIG. 12, all binary samples are coded using context-based arithmetic coding. However, Referring FIG. 13, in another embodiment, for complexity some binary samples on the bit-plane are coded using context-based arithmetic coding and other binary samples on the bit-plane are coded using bit-packing i.e. a probability 1/2 is assigned for that binary samples.

FIG. 14 shows a pseudo code for context-based coding in relation to an embodiment of the present invention.

A lossless audio decoding apparatus and method according to the present invention will now be explained.

Figure 15:
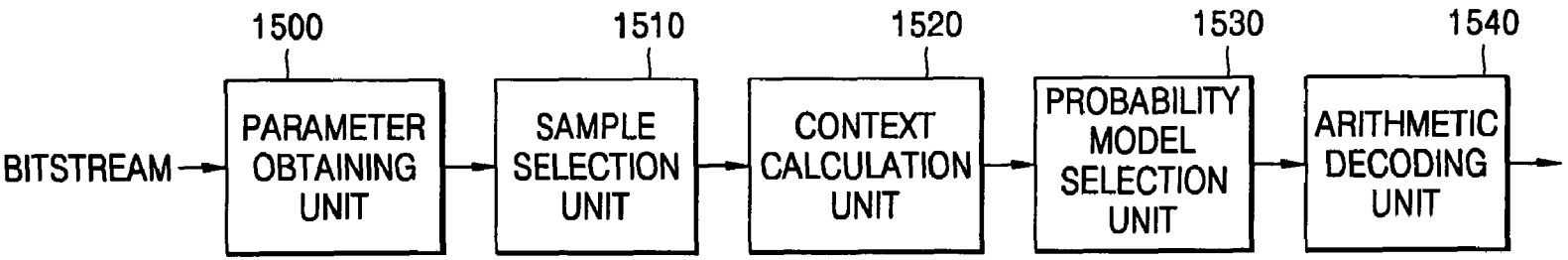
FIG. 15 is a block diagram of the structure of an exemplary embodiment of a lossless audio decoding apparatus according to the present invention.

FIG. 15 is a block diagram of the structure of an exemplary embodiment of a lossless audio decoding apparatus according to the present invention. The apparatus includes a parameter obtaining unit 1500, a sample selection unit 1510, a context calculation unit 1520, a probability model selection unit 1530, and an arithmetic decoding unit 1540.

When a bitstream of audio data is input, the parameter obtaining unit 1500 obtains the MSB and Golomb parameter from the bitstream. The sample selection unit 1510 selects a binary sample to be decoded in the order from a MSB to a LSB and from a lower frequency to a higher frequency.

Figure 16:
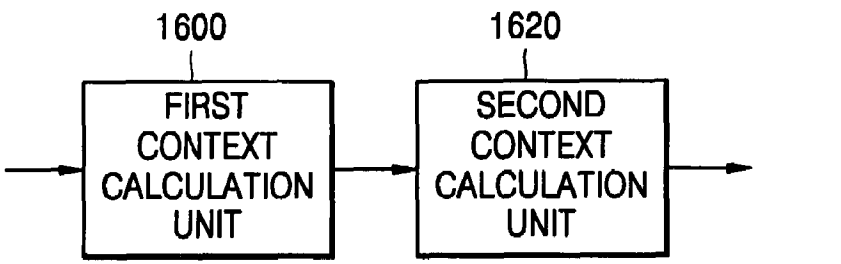
FIG. 16 is a block diagram of the structure of a context calculation unit shown in FIG. 15.

The context calculation unit 1520 calculates a predetermined context by using already decoded samples, and as shown in FIG. 16, is formed with a first context calculation unit 1600 and a second context calculation unit 1620. The first context calculation unit 1600 obtains significances of already coded samples of bit-planes on each identical frequency line in a plurality of frequency lines existing before the frequency line to which the selected binary sample belongs, binarizes the significances, and calculates a first context. The second context calculation unit 1620 obtains significances of already coded samples of bit-planes on each identical frequency line in a plurality of frequency lines existing in the vicinity of the frequency line to which the selected binary sample belongs; expresses a ratio on how many lines among the plurality of frequency lines have significance, in an integer, by multiplying the ratio by a predetermined integer value; and then, calculates a second context by using the integer.

The probability model selection unit 1530 selects a probability model by using the Golomb parameter of the parameter obtaining unit 1500 and the context calculated in the context calculation unit 1520. The arithmetic decoding unit 1540 performs arithmetic-decoding by using the probability model selected in the probability model selection unit 1530.

In FIG. 15 all binary samples are decoded using context-based lossless decoding. However, in another embodiment, for complexity reduction some binary samples on the bit-plane are decoded using context-based lossless decoding and other binary samples on the bit-plane are decoded using bit-packing. Golomb parameter is used for determining binary samples on bit-plane to be decoded using bit-packing since a probability of being '1' of the binary sample under the Golomb parameter is 1/2.

Figure 17:
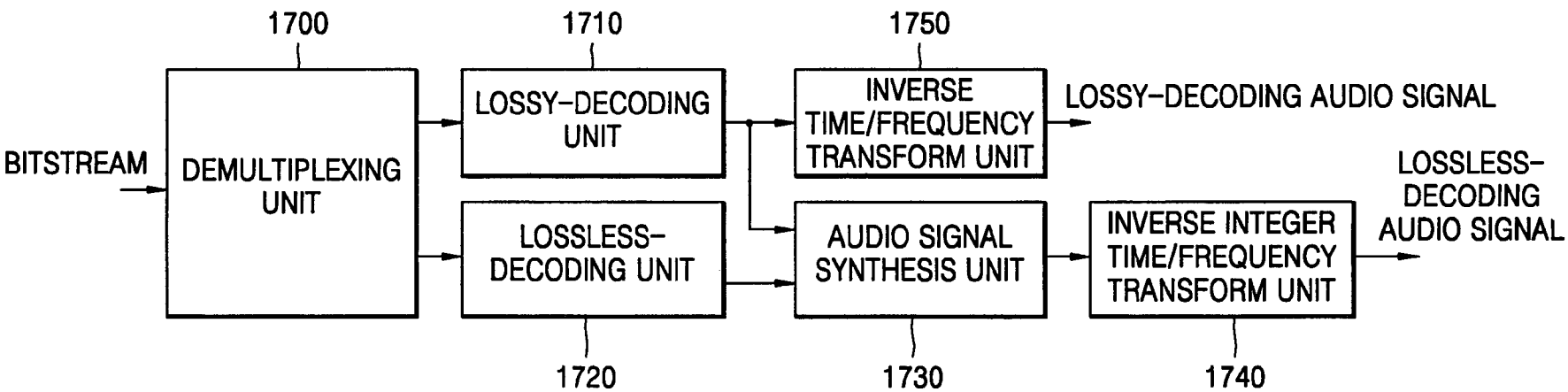
FIG. 17 is a block diagram of the structure of another exemplary embodiment of the lossless audio decoding apparatus according to the present invention.

FIG. 17 is a block diagram of the structure of another exemplary embodiment of the lossless audio decoding apparatus according to the present invention. The apparatus includes a demultiplexing unit 1700, a lossy decoding unit 1710, a lossless decoding unit 1720, an audio signal synthesis unit 1730, and an inverse integer time/frequency transform unit 1740 and preferably, further includes an inverse time/frequency transform unit 1750.

When an audio bitstream is input, the demultiplexing unit 1700 demultiplexes the audio bitstream and extracts a lossy bitstream formed by a predetermined lossy coding method used when the bitstream is coded, and an error bitstream of the error data.

The lossy decoding unit 1710 lossy-decodes the lossy bitstream extracted in the demultiplexing unit 1700, by a predetermined lossy decoding method corresponding to a predetermined lossy coding method used when the bitstream is coded. The lossless decoding unit 1720 lossless-decodes the error bitstream extracted in the demultiplexing unit 1700, also by a lossless decoding method corresponding to lossless coding.

The audio signal synthesis unit 1730 synthesizes the decoded lossy bitstream and error bitstream and restores a frequency spectral signal. The inverse integer time/frequency transform unit 1740 inverse integer time/frequency transforms the frequency spectral signal restored in the audio signal synthesis unit 1730, and restores an audio signal in the time domain.

Then, the inverse time/frequency transform unit 1750 restores the audio signal in the frequency domain decoded in the lossy decoding unit 1710, into an audio signal in the time domain, and the thus restored signal is the lossy decoded signal.

Figure 18:
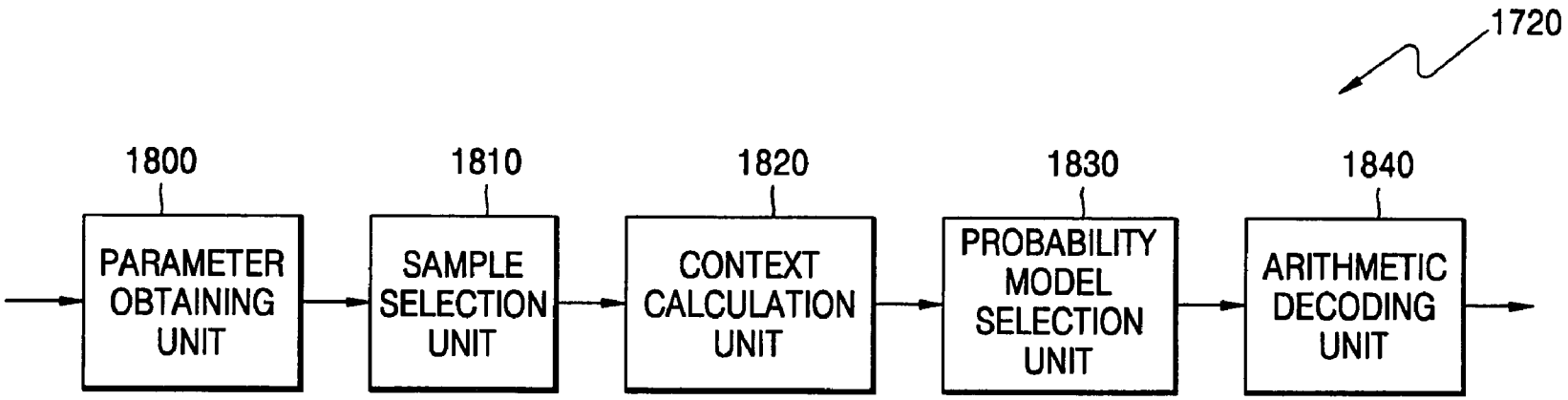
FIG. 18 is a block diagram of the structure of a lossless decoding unit of FIG. 17.

FIG. 18 is a block diagram of the structure of the lossless decoding unit 1720 of FIG. 17, which includes a parameter obtaining unit 1800, a sample selection unit 1810, a context calculation unit 1820, a probability model selection unit 1830, and an arithmetic decoding unit 1840.

The parameter obtaining unit 1800 obtains the MSB and Golomb parameter from a bitstream of audio data. The sample selection unit 1810 selects a binary sample to be decoded in the order from a MSB to a LSB and from a lower frequency to a higher frequency.

The context calculation unit 1820 calculates a predetermined context by using already decoded samples, and is formed with a first context calculation unit 1600 and a second context calculation unit 1620 of FIG. 16. The first context calculation unit 1600 obtains significances of already coded samples of bit-planes on each identical frequency line in a plurality of frequency lines existing before the frequency line to which the selected binary sample belongs, binarizes the significances, and calculates a first context. The second context calculation unit 1620 obtains significances of already coded samples of bit-planes on each identical frequency line in a plurality of frequency lines existing in the vicinity of the frequency line to which the selected binary sample belongs; expresses a ratio on how many lines among the plurality of frequency lines have significance, in an integer, by multiplying the ratio by a predetermined integer value; and then, calculates a second context by using the integer.

The probability model selection unit 1830 selects a probability model by using the Golomb parameter and the context. The arithmetic decoding unit 1840 performs arithmetic-decoding using the selected probability model.

In FIG. 18 all binary samples are decoded using context-based lossless decoding. However, in another embodiment, for complexity reduction some binary samples on the bit-plane are decoded using context-based lossless decoding and other binary samples on the bit-plane are decoded using bit-packing. Golomb parameter is used for determining binary samples on bit-plane to be decoded using bit-packing since a probability of being '1' of the binary sample under the Golomb parameter is 1/2.

Figure 19:
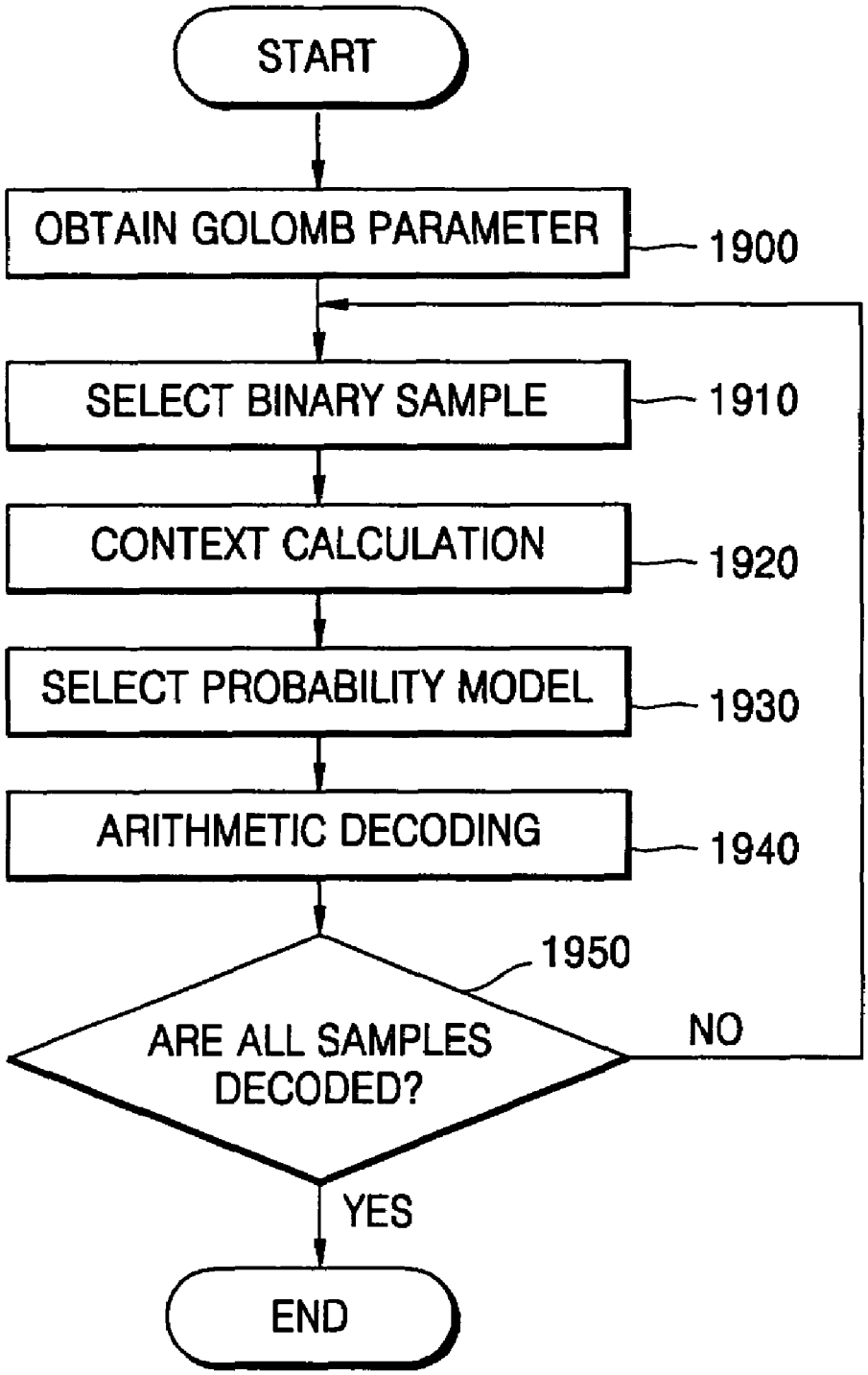
FIG. 19 is a flowchart of the operations performed by the lossless audio decoding apparatus shown in FIG. 15.

FIG. 19 is a flowchart of the operations performed by the lossless audio decoding apparatus shown in FIG. 15.

First, a bitstream of audio data is input to the parameter obtaining unit 1500, a Golomb parameter is obtained from the bitstream of audio data in operation 1900. Then, a binary sample to be decoded in the order from a MSB to a LSB and from a lower frequency to a higher frequency is selected in the sample selection unit 1510 in operation 1910.

If a sample to be decoded is selected in the sample selection unit 1510, a predetermined context is calculated by using already decoded samples in the context calculation unit 1520 in operation 1920. Here, the context is formed with a first context and a second context, and as shown in FIG. 16, the first context calculation unit 1600 obtains significances of already coded samples of bit-planes on each identical frequency line in a plurality of frequency lines existing before the frequency line to which the selected binary sample belongs, binarizes the significances, and calculates a first context. Then, the second context calculation unit 1620 obtains significances of already coded samples of bit-planes on each identical frequency line in a plurality of frequency lines existing in the vicinity of the frequency line to which the selected binary sample belongs; expresses a ratio on how many lines among the plurality of frequency lines have significance, in an integer, by multiplying the ratio by a predetermined integer value; and then, calculates a second context by using the integer.

Then, through the probability model selection unit 1530, a probability model is selected by using the Golomb parameter and the first and second contexts in operation 1930. If the probability model is selected in the probability model selection unit 1530, arithmetic decoding is performed by using the selected probability model in operation 1940. The operations 1910 through 1940 are repeatedly performed until all samples are decoded in operation 1950.

In FIG. 19 all binary samples are decoded using context-based lossless decoding. However, in another embodiment, for complexity reduction some binary samples on the bit-plane are decoded using context-based lossless decoding and other binary samples on the bit-plane are decoded using bit-packing. Golomb parameter is used for determining binary samples on bit-plane to be decoded using bit-packing since a probability of being '1' of the binary sample under the Golomb parameter is 1/2.

Figure 20:
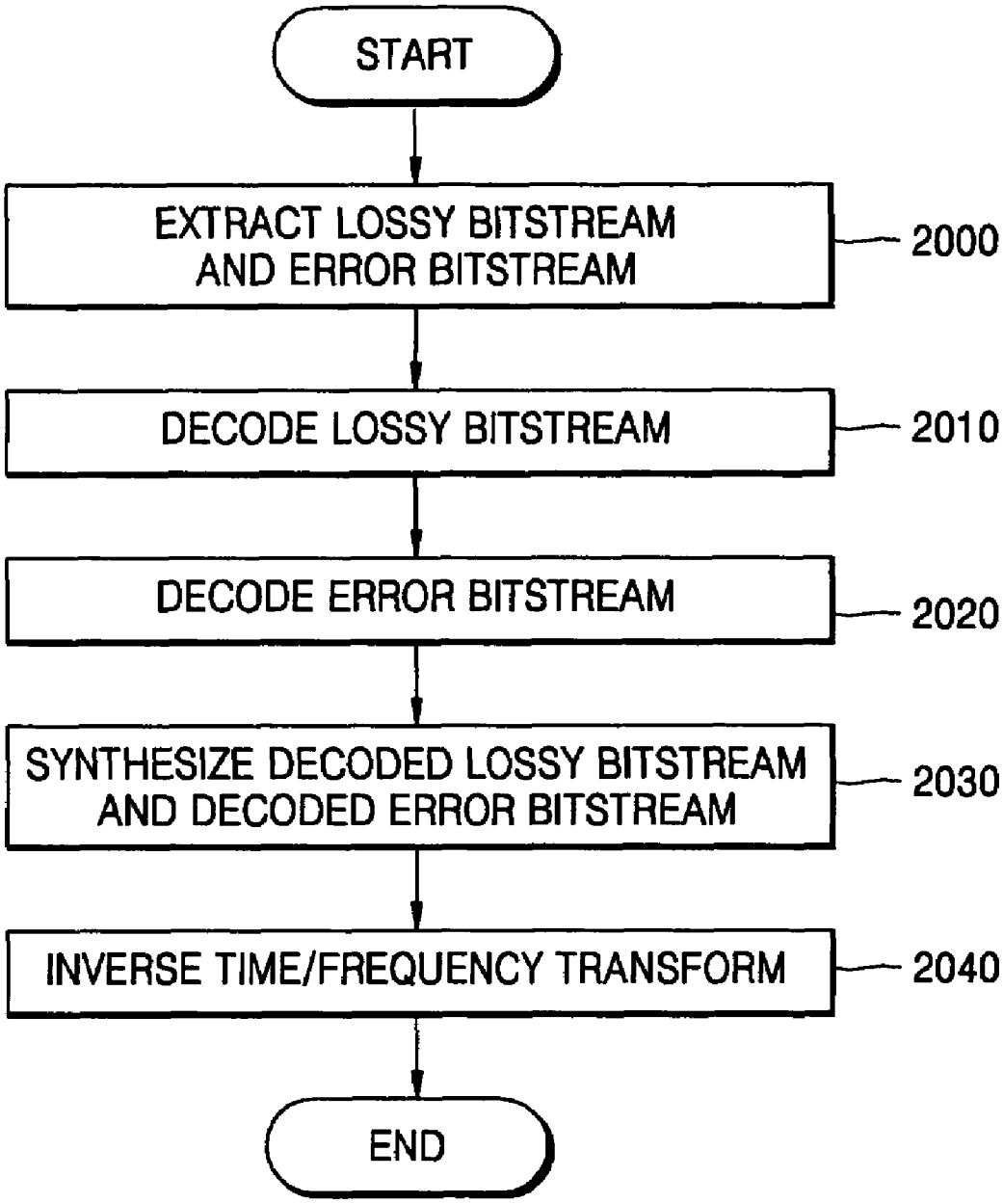
FIG. 20 is a flowchart of the operations performed by the lossless audio decoding apparatus shown in FIG. 17.

FIG. 20 is a flowchart of the operations performed by the lossless audio decoding apparatus shown in FIG. 17.

The difference of lossy-coded audio data and an audio spectral signal in the frequency domain having an integer value will be defined as error data. First, if an audio bitstream is input to the demultiplexing unit 1700, the bitstream is demultiplexed and a lossy bitstream generated through predetermined lossy coding and the error bitstream of the error data are extracted in operation 2000.

The extracted lossy bitstream is input to the lossy decoding unit 1710, and lossy-decoded by a predetermined lossy decoding method corresponding to the lossy coding when the data is coded in operation 2010. Also, the extracted error bitstream is input to the lossless decoding unit 1720 and lossless-decoded in operation 2020. The more detailed process of the lossless decoding in operation 2020 is the same as shown in FIG. 19.

The lossy bitstream lossy-decoded in the lossy decoding unit 1710 and the error bitstream lossless-decoded in the lossless decoding unit 1720 are input to the audio signal synthesis unit 1730 and are restored into a frequency spectral signal in operation 2030. The frequency spectral signal is input to the inverse integer time/frequency transform unit 1740 and is restored to an audio signal in the time domain in operation 2040.

The present invention can also be embodied as computer readable codes on a computer readable recording medium. The computer readable recording medium is any data storage device that can store data which can be thereafter read by a computer system. Examples of the computer readable recording medium include read-only memory (ROM), random-access memory (RAM), CD-ROMs, magnetic tapes, floppy disks, and optical data storage devices.

While the present invention has been particularly shown and described with reference to exemplary embodiments thereof, it will be understood by those of ordinary skill in the art that various changes in form and details may be made therein without departing from the spirit and scope of the present invention as defined by the following claims. The exemplary embodiments should be considered in descriptive sense only and not for purposes of limitation. Therefore, the scope of the invention is defined not by the detailed description of the invention but by the appended claims, and all differences within the scope will be construed as being included in the present invention.

In the lossless audio coding/decoding method and apparatus according to the present invention, an optimal performance can be provided through a model based on statistical distributions using a global context and a local context regardless of the distribution of an input when lossless audio coding and/or decoding is performed. Also, regardless of the assumption that integer MDCT coefficients show a Laplacian distribution, an optimal compression ratio is provided and through a context-based coding method, a compression ratio better than that of the BPGC is provided.

What is claimed is:

1. A lossless audio coding method comprising:

mapping an audio spectral signal in frequency domain having an integer value into a bit-plane signal with respect to frequency;

obtaining a most significant bit and a Golomb parameter for each bit-plane;

selecting a binary sample on a bit-plane to be coded in order from most significant bit to least significant bit and from a lower frequency component to a higher frequency component;

calculating in a computing device contexts of the selected binary sample by using significances of already coded bit-planes for each of a predetermined plurality of frequency lines neighboring a frequency line to which the selected binary sample belongs;

selecting a probability model of the binary sample by using the obtained Golomb parameter and the calculated contexts; and lossless-coding the binary sample by using the selected probability model.

2. The method of claim 1, wherein among the significances, a significance is '1' if there is at least one '1' in already coded bit-planes on each identical frequency line in the predetermined plurality of frequency lines neighboring the frequency line to which the selected binary sample belongs, and if there is no '1', the significance is '0'.

3. The method of claim 1, wherein in the calculating of the contexts of the selected binary sample, the significances of already coded samples of bit-planes on each identical frequency line in the predetermined plurality of frequency lines neighboring the frequency line to which the selected binary sample belongs are obtained, and by binarizing the significances, a context value of the binary sample is calculated.

4. The method of claim 1, wherein in the calculating of the contexts of the selected binary sample, the significances of already coded samples of bit-planes on each identical frequency line in a plurality of frequency lines existing before the frequency line to which the selected binary sample belongs are obtained; a ratio on how many lines among the plurality of frequency lines have significance is expressed in an integer, by multiplying the ratio by a predetermined integer value; and then, a context value of the binary sample is calculated by using the integer.

5. The method of claim 1, wherein the calculating of the contexts of the selected binary sample comprise:

calculating a first context by using the significances of already coded samples of bit-plane on each identical frequency line in the predetermined plurality of frequency lines neighboring the frequency line to which the sample to be coded belongs; and calculating a second context by using the significances of already coded samples of bit-planes on each identical frequency line in a plurality of frequency lines before the frequency line to which the sample to be coded belongs.

6. The method of claim 1, wherein binary samples on the bit-plane are coded with a probability of 0.5.

7. The method of claim 1, further comprising transforming an audio signal in the time domain into the audio spectral signal in frequency domain having the integer value.

8. A lossless audio coding method comprising:

scaling an audio spectral signal in frequency domain having an integer value to be used as an input signal of a lossy coder;

lossy compression coding the scaled frequency signal;

obtaining an error mapped signal corresponding to a difference of the lossy coded data and the audio spectral signal in frequency domain having an integer value;

lossless-coding in a computing device the error mapped signal by using a context obtained based on the significances of already coded bit-planes for each of a predetermined plurality of frequency lines neighboring a frequency line to which the error mapped signal belongs; and generating a bitstream by multiplexing the lossless coded signal and the lossy coded signal.

9. The method of claim 8, wherein among the significances, a significance is '1' if there is at least one '1' in already coded bit-planes on each identical frequency line in the predetermined plurality of frequency lines neighboring the frequency line to which the selected binary sample belongs, and if there is no '1', the significance is '0'.

10. The method of claim 8, wherein the lossless-coding of the error mapped signal comprises:

mapping the error mapped signal into bit-plane data with respect to frequency;

obtaining a most significant bit and Golomb parameter of the bit-plane;

selecting a binary sample on a bit-plane to be coded in order from a most significant bit to a least significant bit and a lower frequency component to a higher frequency component;

calculating contexts of the selected binary sample by using significances of already coded bit-planes for each of the predetermined plurality of frequency lines neighboring the frequency line to which the selected binary sample belongs;

selecting a probability model of the binary sample by using the obtained Golomb parameter and the calculated contexts; and lossless-coding the binary sample by using the selected probability model.

11. The method of claim 10, wherein in the calculating of the contexts of the selected binary sample, the significances of already coded samples of bit-planes on each identical frequency line in the predetermined plurality of frequency lines neighboring the frequency line to which the selected binary sample belongs are obtained, and by binarizing the significances, the context value of the binary sample is calculated.

12. The method of claim 10, wherein in the calculating of the contexts of the selected binary sample, the significances of already coded samples of bit-planes on each identical frequency line in the plurality of frequency lines existing before the frequency line to which the selected binary sample belongs are obtained; a ratio on how many lines among the plurality of frequency lines have significance is expressed in an integer, by multiplying the ratio by a predetermined integer value; and then, a context value is calculated by using the integer.

13. The method of claim 10, wherein the calculating of the contexts of the selected binary sample comprise:

calculating a first context by using the significances of already coded samples of bit-plane on each identical frequency line in a predetermined plurality of frequency lines neighboring the frequency line to which the sample to be coded belongs; and calculating a second context by using the significances of already coded samples of bit-planes on each identical frequency line in a plurality of frequency lines before the frequency line to which the sample to be coded belongs.

14. The method of claim 10, wherein binary samples on the bit-plane are coded with a probability of 0.5.

15. The method of claim 8, further comprising transforming an audio signal in the time domain into the audio spectral signal in frequency domain having the integer value.

16. A computer readable recording memory having embodied thereon a computer program for, when executed by a computer, carrying out a method in accordance with claim 8.

17. A lossless audio coding apparatus comprising:

a bit-plane mapping unit mapping an audio signal in frequency domain having an integer value into bit-plane data with respect to frequency;

a parameter obtaining unit obtaining a most significant bit and a Golomb parameter for each bit-plane in the bit-plane data;

a binary sample selection unit selecting a binary sample on a bit-plane to be coded in order from most significant bit to least significant bit and from a lower frequency component to a higher frequency component;

a context calculation unit calculating contexts of the selected binary sample by using significances of already coded bit-planes for each of a predetermined plurality of frequency lines neighboring a frequency line to which the selected binary sample belongs;

a probability model selection unit selecting a probability model of the binary sample by using the obtained Golomb parameter and the calculated contexts; and a binary sample coding unit lossless-coding the binary sample by using the selected probability model.

18. The apparatus of claim 17, wherein among the significances, a significance is '1' if there is at least one '1' in already coded bit-planes on each identical frequency line in the predetermined plurality of frequency lines neighboring the frequency line to which the selected binary sample belongs, and if there is no '1', the significance is '0'.

19. The apparatus of claim 17, wherein the context calculation unit comprises:

a first context calculation unit calculating a first context by obtaining the significances of already coded samples of bit-planes on each identical frequency line in a predetermined plurality of frequency lines neighboring the frequency line to which the sample to be coded belongs and binarizing the significances; and a second context calculation unit calculating a second context by obtaining the significances of already coded samples of bit-planes on each identical frequency line in a plurality of frequency lines existing before the frequency line to which the sample to be coded belongs, expressing a ratio on how many lines among the plurality of frequency lines have significance, in an integer by multiplying the ratio by a predetermined integer value, and then, by using the integer.

20. The apparatus of claim 17, further comprising an integer/frequency transform unit transforming an audio signal in the time domain into the audio spectral signal in frequency domain having the integer value.

21. The apparatus of claim 20, wherein the integer time/frequency transform unit is an integer modified discrete cosine transform (MDCT) unit.

22. The apparatus of claim 17, wherein binary samples on the bit-plane are coded with a probability of 0.5.

23. A lossless audio coding apparatus comprising:

a scaling unit scaling an audio spectral signal in frequency domain having an integer value to be used as an input signal of a lossy coder;

a lossy coding unit lossy compression coding the scaled frequency signal;

an error mapping unit obtaining a difference of the lossy coded signal and the signal of the integer time/frequency transform unit;

a lossless coding unit lossless-coding the error mapped signal by using a context obtained based on the significances of already coded bit-planes for each of a predetermined plurality of frequency lines neighboring a frequency line to which the error mapped signal belongs; and a multiplexer generating a bitstream by multiplexing the lossless coded signal and the lossy coded signal.

24. The apparatus of claim 23, wherein among the significances, a significance is '1' if there is at least one '1' in already coded bit-planes on each identical frequency line in the predetermined plurality of frequency lines neighboring the frequency line to which the selected binary sample belongs, and if there is no '1', the significance is '0'.

25. The apparatus of claim 23, wherein the lossless-coding unit comprises:

a bit-plane mapping unit mapping the error mapped signal of the error mapping unit into bit-plane data with respect to frequency;

a parameter obtaining unit obtaining a most significant bit and Golomb parameter of the bit-plane;

a binary sample selection unit selecting a binary sample on a bit-plane to be coded in order from a most significant bit to a least significant bit and a lower frequency component to a higher frequency component;

a context calculation unit calculating contexts of the selected binary sample by using the significances of already coded bit-planes for each of the predetermined plurality of frequency lines neighboring the frequency line to which the selected binary sample belongs;

a probability model selection unit selecting a probability model of the binary sample by using the obtained Golomb parameter and the calculated contexts; and a binary sample coding unit lossless-coding the binary sample by using the selected probability model.

26. The apparatus of claim 25, wherein the context calculation unit comprises:

a first context calculation unit calculating a first context by obtaining the significances of already coded samples of bit-planes on each identical frequency line in a predetermined plurality of frequency lines neighboring the frequency line to which the sample to be coded belongs and binarizing the significances; and a second context calculation unit calculating a second context by obtaining the significances of already coded samples of bit-planes on each identical frequency line in a plurality of frequency lines existing before the frequency line to which the sample to be coded belongs, expressing a ratio on how many lines among the plurality of frequency lines have significance, in an integer by multiplying the ratio by a predetermined integer value, and then, using the integer.

27. The apparatus of claim 25, wherein binary samples on the bit-plane are coded with a probability of 0.5.

28. The apparatus of claim 23, further comprising an integer time/frequency transform unit transforming an audio signal in the time domain into the audio spectral signal in frequency domain having the integer value.

29. A lossless audio decoding method comprising:

obtaining a Golomb parameter from a bitstream of audio data;

selecting a binary sample to be decoded in order from a most significant bit to a least significant bit and from a lower frequency to a higher frequency;

calculating in a computing device a context of a binary sample to be decoded by using significances of already decoded bit-planes for each of a predetermined plurality of frequency lines neighboring a frequency line to which the binary sample to be decoded belongs;

selecting a probability model of the binary sample by using the Golomb parameter and the context;

performing arithmetic-decoding by using the selected probability model; and repeatedly performing the operations from the selecting of a binary sample to be decoded to the arithmetic decoding until all samples are decoded.

30. The method of claim 29, wherein among the significances, a significance is '1' if there is at least one '1' in already decoded bit-planes on each identical frequency line in the predetermined plurality of frequency lines neighboring the frequency line to which the selected binary sample belongs, and if there is no '1', the significance is '0'.

31. The method of claim 29, wherein in the calculating of the context of the selected binary sample, the significances of already decoded samples of bit-planes on each identical frequency line in the predetermined plurality of frequency lines neighboring the frequency line to which the selected binary sample belongs are obtained, and by binarizing the significances, a context value of the binary sample is calculated.

32. The method of claim 29, wherein in the calculating of the context of the selected binary sample, the significances of already decoded samples of bit-planes on each identical frequency line in a plurality of frequency lines existing before the frequency line to which the selected binary sample belongs are obtained; a ratio on how many lines among the plurality of frequency lines have significance is expressed in an integer, by multiplying the ratio by a predetermined integer value; and then, a context value of the binary sample is calculated by using the integer.

33. The method of claim 29, wherein the calculating of the context comprises:

calculating a first context by using the significances of already decoded samples of bit-plane on each identical frequency line in a predetermined plurality of frequency lines neighboring the frequency line to which the sample to be decoded belongs; and calculating a second context by using the significances of already decoded samples of bit-planes on each identical frequency line in a plurality of frequency lines before the frequency line to which the sample to be decoded belongs.

34. The method of claim 29, wherein binary samples on the bit-plane are decoded with a probability of 0.5.

35. A computer readable recording memory having embodied thereon a computer program for, when executed by a computer, carrying out a method of in accordance with claim 29.

36. A lossless audio decoding method wherein the difference of lossy coded audio data and an audio spectral signal in frequency domain having an integer value is referred to as error data, the method comprising:

extracting a lossy bitstream lossy-coded in a predetermined method and an error bitstream of the error data, by demultiplexing an audio bitstream;

lossy-decoding the extracted lossy bitstream in a predetermined method;

lossless-decoding in a computing device the extracted error bitstream, by using a context based on significances of already decoded samples of bit-planes on each identical line of a predetermined plurality of frequency lines neighboring a frequency line to which a sample to be decoded belongs; and restoring a frequency spectral signal by using the decoded lossy bitstream and error bitstream; and restoring an audio signal in the time domain by inverse integer time/frequency transforming the frequency spectral signal.

37. The method of claim 36, wherein among the significances, a significance is '1' if there is at least one '1' in already decoded bit-planes on each identical frequency line in the predetermined plurality of frequency lines neighboring the frequency line to which the selected binary sample belongs, and if there is no '1', the significance is '0'.

38. The method of claim 36, wherein the lossless-decoding of the extracted error bitstream comprises:

obtaining a Golomb parameter from a bitstream of audio data;

selecting the binary sample to be decoded in order from a most significant bit to a least significant bit and from a lower frequency to a higher frequency;

calculating a context of the selected binary sample by using significances of already coded bit-planes for each of the predetermined plurality of frequency lines neighboring the frequency line to which the selected binary sample belongs;

selecting a probability model of the binary sample by using the Golomb parameter and context;

performing arithmetic-decoding by using the selected probability model; and repeatedly performing the operations from selecting the binary sample to performing arithmetic-decoding, until all samples are decoded.

39. The method of claim 38, wherein in the calculating of the context of the selected binary sample, the significances of already decoded samples of bit-planes on each identical frequency line in the predetermined plurality of frequency lines neighboring the frequency line to which the selected binary sample belongs are obtained, and by binarizing the significances, a context value of the binary sample is calculated.

40. The method of claim 38, wherein in the calculating of the context of the selected binary sample, the significances of already decoded samples of bit-planes on each identical frequency line in a plurality of frequency lines existing before the frequency line to which the selected binary sample belongs are obtained; a ratio on how many lines among the plurality of frequency lines have significance is expressed in an integer, by multiplying the ratio by a predetermined integer value; and then, a context value of the binary sample is determined by using the integer.

41. The method of claim 38, wherein in the calculating of the context comprises:

calculating a first context by using the significances of already decoded samples of bit-plane on each identical frequency line in the predetermined plurality of frequency lines neighboring the frequency line to which the sample to be decoded belongs; and calculating a second context by using the significances of already decoded samples of bit-planes on each identical frequency line in a plurality of frequency lines before the frequency line to which the sample to be decoded belongs.

42. The method of claim 38, wherein binary samples on the bit-plane are decoded with a probability of 0.5.

43. A computer readable recording memory having embodied thereon a computer program for, when executed by a computer, carrying out a method of in accordance with claim 36.

44. A lossless audio decoding apparatus comprising:

a parameter obtaining unit obtaining a Golomb parameter from a bitstream of audio data;

a sample selection unit selecting a binary sample to be decoded in order from a most significant bit to a least significant bit and from a lower frequency to a higher frequency;

a context calculation unit calculating in a computing device a context of a binary sample to be decoded by using significances of already decoded bit-planes for each of a predetermined plurality of frequency lines neighboring a frequency line to which the binary sample to be decoded belongs;

a probability model selection unit selecting a probability model by using the Golomb parameter and the context; and an arithmetic decoding unit performing arithmetic-decoding by using the selected probability model.

45. The apparatus of claim 44, wherein among the significances, a significance is '1' if there is at least one '1' in already decoded bit-planes on each identical frequency line in the predetermined plurality of frequency lines neighboring the frequency line to which the selected binary sample belongs, and if there is no '1', the significance is '0'.

46. The apparatus of claim 44, wherein the context calculation unit comprises:

a first context calculation unit calculating a first context by obtaining the significances of already decoded samples of bit-planes on each identical frequency line in the predetermined plurality of frequency lines neighboring the frequency line to which a sample to be decoded belongs and binarizing the significances; and a second context calculation unit calculating a second context by obtaining the significances of already decoded samples of bit-planes on each identical frequency line in a plurality of frequency lines existing before the frequency line to which the sample to be decoded belongs, expressing a ratio on how many lines among the plurality of frequency lines have significance, in an integer by multiplying the ratio by a predetermined integer value, and then, by using the integer.

47. The apparatus of claim 44, wherein binary samples on the bit-plane are decoded with a probability of 0.5.

48. A lossless audio decoding apparatus wherein the difference of lossy coded audio data and an audio spectral signal in frequency domain having an integer value is referred to as error data, the apparatus comprising:

a demultiplexing unit extracting a lossy bitstream lossy-coded in a predetermined method and an error bitstream of the error data, by demultiplexing an audio bitstream;

a lossy decoding unit lossy-decoding the extracted lossy bitstream in a predetermined method;

a lossless decoding unit lossless-decoding the extracted error bitstream, by using a context based on significances of already decoded samples of bit-planes on each identical line of a predetermined plurality of frequency lines neighboring a frequency line to which a sample to be decoded belongs; and an audio signal synthesis unit restoring a frequency spectral signal by synthesizing the decoded lossy bitstream and error bitstream.

49. The apparatus of claim 48, wherein the lossy decoding unit is an AAC decoding unit.

50. The apparatus of claim 48, further comprising:

an inverse integer time/frequency transform unit restoring an audio signal in the time domain by inverse integer time/frequency transforming the frequency spectral signal.

51. The apparatus of claim 48, further comprising:

an inverse time/frequency transform unit restoring an audio signal in the time domain from an audio signal in frequency domain decoded by the lossy decoding unit.

52. The apparatus of claim 48, wherein among the significances, a significance is '1' if there is at least one '1' in already decoded bit-planes on each identical frequency line in the predetermined plurality of frequency lines neighboring the frequency line to which the selected binary sample belongs, and if there is no '1', the significance is '0'.

53. The apparatus of claim 48, wherein the lossless decoding unit comprises:

a parameter obtaining unit obtaining a Golomb parameter from a bitstream of audio data;

a sample selection unit selecting a binary sample to be decoded in order from a most significant bit to a least significant bit and from a lower frequency to a higher frequency;

a context calculation unit calculating a context of the selected binary sample by using significances of already coded bit-planes for each of the predetermined plurality of frequency lines neighboring of the frequency line to which the selected binary sample belongs;

a probability model selection unit selecting a probability model of the binary sample by using the Golomb parameter and context; and an arithmetic decoding unit performing arithmetic-decoding by using the selected probability model.

54. The apparatus of claim 53, wherein the context calculation unit comprises:

a first context calculation unit obtaining the significances of already coded samples of bit-planes on each identical frequency line in the predetermined plurality of frequency lines neighboring the frequency line to which the selected binary sample belongs, and by binarizing the significances, calculating a first context; and a second context calculation unit obtaining the significances of already coded samples of bit-planes on each identical frequency line in a plurality of frequency lines existing before the frequency line to which the selected binary sample belongs, expressing a ratio on how many lines among the plurality of frequency lines have significance, in an integer, by multiplying the ratio by a predetermined integer value, and then, calculating a second context by using the integer.

55. The apparatus of claim 53, wherein binary samples on the bit-plane are decoded with probability of 0.5.

56. A computer readable recording memory having embodied thereon a computer program for, when executed by a computer, carrying out a method of in accordance with claim 1.

57. A lossless audio decoding method comprising:

obtaining a Golomb parameter from a bitstream of audio data;

selecting bit-plane symbols to be decoded in order from a most significant bit to a least significant bit and from a lowest frequency component to a highest frequency component;

calculating, in a computing device, contexts using the significances of already decoded bit-plane symbols, and selecting a probability model of bit-plane symbols using the contexts; and performing arithmetic-decoding by using the selected probability model.

58. A lossless audio decoding method comprising:

obtaining a Golomb parameter from a bitstream of audio data;

selecting binary samples to be decoded in order from a most significant bit to a least significant bit;

calculating, in a computing device, contexts using significances of already decoded binary samples, and selecting a probability model of binary samples using the contexts; and performing arithmetic-decoding by using the selected probability model.

59. A lossless audio decoding method comprising:

obtaining a Golomb parameter from a bitstream of audio data;

selecting bit-plane symbols to be decoded in order from a most significant bit to a least significant bit and from a lowest frequency component to a highest frequency component;

calculating, in a computing device, contexts using significances of already decoded bit-plane symbols, and selecting a probability model of bit-plane symbols using the contexts;

performing arithmetic-decoding by using the selected probability model; and repeatedly performing the operations of the selecting of the bit-plane symbols, the calculating of contexts, and the arithmetic-decoding until all bit-plane symbols are decoded.

60. A lossless audio decoding method comprising:

obtaining a Golomb parameter from a bitstream of audio data;

selecting binary samples to be decoded in order from a most significant bit to a least significant bit;

calculating, in a computing device, contexts using significances of already decoded binary samples, and selecting a probability model of binary samples using the contexts;

performing arithmetic-decoding by using the selected probability model; and repeatedly performing the operations of the selecting of the binary samples, the calculating of contexts, and the arithmetic-decoding until all binary samples are decoded.

61. A computer readable recording memory having recorded thereon a computer readable program that when executed by a computer, causes a computer to execute:

obtaining a Golomb parameter from a bitstream of audio data;

selecting bit-plane symbols to be decoded in order from a most significant bit to a least significant bit and from a lowest frequency component to a highest frequency component;

calculating contexts using significances of already decoded bit-plane symbols, and selecting a probability model of bit-plane symbols using the contexts; and performing arithmetic-decoding by using the selected probability model.

62. A computer readable recording memory having recorded thereon a computer readable program that when executed by a computer, causes a computer to execute:

obtaining a Golomb parameter from a bitstream of audio data;

selecting binary samples to be decoded in order from a most significant bit to a least significant bit;

calculating contexts using significances of already decoded binary samples, and selecting a probability model of binary samples using the contexts; and performing arithmetic-decoding by using the selected probability model.

63. A computer readable recording memory having recorded thereon a computer readable program that when executed by a computer, causes a computer to execute:

obtaining a Golomb parameter from a bitstream of audio data;

selecting bit-plane symbols to be decoded in order from a most significant bit to a least significant bit and from a lowest frequency component to a highest frequency component;

calculating contexts using significances of already decoded bit-plane symbols, and selecting a probability model of bit-plane symbols using the contexts;

performing arithmetic-decoding by using the selected probability model; and repeatedly performing the operations of the selecting of the bit-plane symbols, the calculating of contexts, and the arithmetic-decoding until all bit-plane symbols are decoded.

64. A computer readable recording memory having recorded thereon a computer readable program that when executed by a computer, causes a computer to execute:

obtaining a Golomb parameter from a bitstream of audio data;

selecting binary samples to be decoded in order from a most significant bit to a least significant bit;

calculating contexts using significances of already decoded binary samples, and selecting a probability model of binary samples using the contexts; and performing arithmetic-decoding by using the selected probability model, repeatedly performing the operations of the selecting of the binary samples, the calculating of contexts, and the arithmetic-decoding until all binary samples are decoded.

* * * * *

UNITED STATES PATENT AND TRADEMARK OFFICE

CERTIFICATE OF CORRECTION

PATENT NO. : 7,660,720 B2
APPLICATION NO. : 11/076284
DATED : February 9, 2010
INVENTOR(S) : Ennmi Oh et al.

It is certified that error appears in the above-identified patent and that said Letters Patent is hereby corrected as shown below:

Column 20, Line 8, change "method of" to --method--.

Column 21, Line 21, change "method of" to --method--.

Column 23, Line 7, change "method of" to --method--.

Signed and Sealed this

Eleventh Day of May, 2010

David J. Kappos

David J. Kappos
*Director of the United States Patent and Trademark Office*